US007366457B2

(12) United States Patent
Ono

(10) Patent No.: US 7,366,457 B2
(45) Date of Patent: Apr. 29, 2008

(54) COLOR IMAGE FORMING APPARATUS HAVING TONER RECYCLING

(75) Inventor: Kazuaki Ono, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 227 days.

(21) Appl. No.: 11/168,355

(22) Filed: Jun. 29, 2005

(65) Prior Publication Data

US 2006/0002750 A1 Jan. 5, 2006

(30) Foreign Application Priority Data

Jul. 1, 2004 (JP) ..... 2004-196085

(51) Int. Cl.
*G03G 15/01* (2006.01)
*G03G 21/00* (2006.01)

(52) U.S. Cl. ..... 399/344; 399/359

(58) Field of Classification Search ..... 399/39, 399/53, 61, 71, 101, 224, 254, 258, 259, 399/344, 358, 359

See application file for complete search history.

(56) References Cited

U.S. PATENT DOCUMENTS

| | | | | |
|---|---|---|---|---|
| 6,226,490 | B1 * | 5/2001 | Fujita et al. | 399/359 |
| 6,721,534 | B2 | 4/2004 | Takahashi | 399/359 |
| 6,782,234 | B2 * | 8/2004 | Takami | 399/359 |
| 6,879,787 | B2 * | 4/2005 | Iino | 399/29 |
| 2006/0013604 | A1 * | 1/2006 | Kadota et al. | 399/49 |
| 2006/0204272 | A1 * | 9/2006 | Ikeda et al. | 399/101 |
| 2006/0216086 | A1 * | 9/2006 | Yuasa et al. | 399/358 |

FOREIGN PATENT DOCUMENTS

| | | | |
|---|---|---|---|
| JP | 07191586 | A * | 7/1995 |
| JP | 7-281484 | A | 10/1995 |
| JP | 8-63067 | | 3/1996 |
| JP | 8-248853 | | 9/1996 |

(Continued)

OTHER PUBLICATIONS

English-language translation of an Office Action, i.e., a Notification of Reasons for Rejection, dated Aug. 1, 2006, issued in Japanese counterpart Patent Application No. 2004-196085.

*Primary Examiner*—Robert Beatty
(74) *Attorney, Agent, or Firm*—Fitzpatrick, Cella, Harper & Scinto

(57) ABSTRACT

The image forming apparatus having a plurality of developing devices corresponding to a plurality of colors includes at least a predetermined color for developing an electrostatic image as toner images, an image bearing member bearing thereon the toner images developed by the plurality of developing devices, and a collecting device for collecting residual toners on the image bearing member after the toner images of the respective colors formed on the image bearing member have been respectively transferred onto a recording material. The collected toners with plural colors mixed together provide a pseudo-predetermined color, and a changing device capable of supplying the collected toners and the toner for the predetermined color to the developing device for the predetermined color, and changing the mixing ratio of the collected toners and the fresh toner for the predetermined color supplied to the developing device for the predetermined color, in conformity with the ratio of the toners of the respective colors constituting the toner of the pseudo predetermined color occupied in the collected toners.

12 Claims, 10 Drawing Sheets

FOREIGN PATENT DOCUMENTS

| | | | | |
|---|---|---|---|---|
| JP | 09096939 | A | * | 4/1997 |
| JP | 2000-35703 | | | 2/2000 |
| JP | 2001-337503 | | | 12/2001 |
| JP | 2002-40748 | A | | 2/2002 |
| JP | 2002365873 | A | * | 12/2002 |
| JP | 2003-15494 | | | 1/2003 |
| JP | 2003-149911 | A | | 5/2003 |
| JP | 2003-345096 | A | | 12/2003 |

* cited by examiner

COLOR IMAGE FORMING APPARATUS HAVING TONER RECYCLING

BACKGROUND OF THE INVENTION

1. Field of the Invention

This invention relates to an image forming apparatus such as a copying machine, a facsimile apparatus or a laser beam printer.

2. Related Background Art

In recent years, needs for coloring have been rising in image forming apparatuses such as copying machines and laser beam printers. As a color image forming process, the electrophotographic process is said to be excellent in that the image forming speed is high.

Color image forming apparatuses of the electrophotographic type include (i) a so-called one-drum type color image forming apparatus provided with a plurality of developing devices corresponding to a plurality of colors around an electrophotographic photosensitive member (hereinafter referred to as the "photosensitive member") as an image bearing member, and (ii) a so-called tandem type color image forming apparatus provided with developing devices discretely for a plurality of photosensitive members.

The one-drum type has a single photosensitive member, and this leads to the merits that it can be relatively downsized and that cost can be reduced. However, image forming is repeated a plurality of times (usually four times) by the use of the single photosensitive member to thereby form a full-color image and therefore, this type is limited in the heightening of a color image forming speed. In the one-drum type color image forming apparatus, there is known (1) one in which images by toners of plural colors as developers are superposedly formed on the photosensitive member, whereafter these toner images are collectively transferred to a recording material, and (2) one in which toner images of different colors are successively formed on the photosensitive member, and each of them is respectively transferred to a recording material borne on a recording material conveying member and are superposed one upon another, or are respectively transferred to an intermediate transfer member and are superposed one upon another, and thereafter are collectively transferred to a recording material.

On the other hand, the tandem type has the merit that the heightening of the color image forming speed is possible. Recently, a speed as high as that for monochromatic image forming is required for color image forming and thus, attention has been paid to the tandem type. In a color image forming apparatus of the tandem type, there is known one in which toner images formed by toners of different colors on a plurality of photosensitive members are transferred to a recording material borne on a recording material conveying member and are superposed one upon another, or one in which the toner images are successively transferred to an intermediate transfer member and are superposed one upon another, and thereafter are collectively transferred to a recording material.

Among these color image forming apparatuses, the intermediate transfer type using the intermediate transfer member is occupying the mainstream, because this type has the merits that this type makes no choice of recording materials and that it is excellent in color registration (suffers little from color misregister).

Describing an image forming apparatus of this intermediate transfer type as an example, any toners residual on the surfaces of the photosensitive member and the intermediate transfer member (hereinafter referred to as the "untransferred toners") after the transferring step in the image forming process are generally removed by cleaning means. Heretofore, a cleaning device as the cleaning means is provided with a cleaning member such as a fur brush or a cleaning blade, and the toners collected by the cleaning device are carried by toner carrying means provided with a screw, an auger, a belt or the like as a carrying member, for example, in a pipe-shaped carrying path, and are collected into a toner disposal container as toner disposal means.

Usually, the toner disposal container, when filled with the toners, is disposed of by an operator and is replaced with a new empty toner disposal container.

Now, in recent years, downsizing, a higher function, coloring and a higher speed have been advanced for color image forming apparatuses, while on the other hand, there have been rising requirements for improved reliability, system evolution, maintenance-freedom, a low running cost, effective utilization of resources, consideration to environments, etc. Particularly, there are demands for the consideration to environments, the low running cost, etc.

In the conventional color image forming apparatus, however, the untransferred toners are collected into the toner disposal container and are disposed of and therefore, the effective utilization of resources, the consideration to environments and the low running cost have been tasks.

As regards the untransferred toner, in a single-color (usually monochromatic) image forming apparatus, the recycling thereof has been put into practical use, but in a color image forming apparatus, the recycling of the toners of plural colors mixed together has been difficult because of the problem that the color taste of an image changes.

Japanese Patent Application Laid-open No. H08-63067 proposes, in an image forming apparatus of the one-drum type (particularly a full-color image forming apparatus in which multiple developer images formed on a photosensitive member are collectively transferred to a recording material), to supply toners collected from on the photosensitive member by a cleaning device to a developing device for black. In this prior art, the mixing ratio between the collected toners to be supplied to the developing device for black and the black toner is controlled so that [collected toners/(black toner+collected toners)]≦60%. This prior art, however, does not mention that the supply ratio between the collected toners and the black toner when the collected toners with the toners of plural colors mixed together therein are supplied to the developing device for black is made variable.

Japanese Patent Application Laid-open No. H08-248853 proposes, in an image forming apparatus of the one-drum type (particularly an image forming apparatus in which toner images of two colors formed on a photosensitive member are collectively transferred to a recording material), to dispose two kinds of cleaning devices for the disposal and recycling, respectively, of untransferred toners, and determine into which of the two kinds of cleaning devices the untransferred toners on the photosensitive member are collected, from the color information of written-in data in conformity with the mixing ratio of the color toners. In this prior art, from the pixel data percentage of an original image, only when the black image is 100% (or 98% or more), the cleaning device for recycling is operated and the collected toners are carried to a developing device for black and are recycled. However, when the mixing ratio departs from a desired range, the collected untransferred toners have not been recycled but have been disposed of, and have not been effectively utilized. For example, in a case where this prior art is applied to a four-color full-color image forming apparatus, if the number of full-color images is great, there is the undesirable possibility that the toners disposed of may increase.

Japanese Patent Application Laid-open No. 2000-35703 proposes, in an image forming apparatus of the tandem type (particularly, a full-color image forming apparatus in which toner images are multiplexly transferred from a plurality of photosensitive-members to a recording material borne on a recording material conveying member), to provide a developing device for a recycled developer discrete from a developing device for black used in a color image forming process. Untransferred toners of respective colors are gathered at a location and these toners are utilized as recycled toners in the developing device for the recycled developer. That is, in this method, the collected toners are not returned to the developing device for black, but are recycled as pseudo black. This prior art, however, collects Y, M and C toners in equal amounts and mixes them to thereby make the mixture into a pseudo black toner and therefore, cannot recycle the toners when the consumed amounts of the respective toners are not equal to one another. This prior art gives no consideration to controlling the mixing ratio of the collected toners and a new toner in conformity with the ratio of the toner of each color in the collected toners which becomes important when the collected toners with plural colors mixed together therein are utilized for color image forming.

Japanese Patent Application Laid-open No. 2001-337503 proposes, in a cleanerless image forming apparatus of the tandem type (particularly a full-color image forming apparatus in which toner images multiplexly transferred from a plurality of photosensitive members to an intermediate transfer member are collectively transferred to a recording material and untransferred toners are collected into developing devices for respective colors), a method of controlling color mixing in the developing devices for respective colors so that the untransferred toners may get mixed in the developing device located on the downstream side with respect to the moving direction of the intermediate transfer member, within a predetermined allowable value of color mixing. This prior art, however, recycles the toners collected from respective photosensitive members by cleaning devices provided correspondingly thereto in developing devices for respective colors provided correspondingly to the respective photosensitive members, and does not collectively recycle the collected toners with plural colors mixed together therein, in the developing device for black.

Japanese Patent Application Laid-open No. 2003-15494 proposes, in a color image forming apparatus of the tandem type (particularly a full-color image forming apparatus in which toner images multiplexly transferred from a plurality of photosensitive members to an intermediate transfer member are collectively transferred to a recording member), to return to respective developing devices the toners collected from the respective photosensitive members by cleaning devices provided correspondingly to the respective photosensitive members and recycle these toners. Also, in this publication, it is described that in conformity with the mixing rate of the toners collected in the respective cleaning devices, the supply amounts of these toners and a new toner are made variable. This prior art, however, recycles the toners collected from the respective photosensitive members by the cleaning devices provided correspondingly thereto in the developing devices for respective colors provided correspondingly to the respective photosensitive members, and further relates to the mixing of two colors in which the toner one color upstream of the other, and does not collectively recycle the collected toners with plural colors mixed together therein, in the developing device for black.

To recycle the toner collected by each cleaning device in the developing device for each color, as in Japanese Patent Application Laid-open No. 2001-337503 and Japanese Patent Application Laid-open No. 2003-15494, a complicated construction and control are required to suppress the influence of the color mixing of the toners collected by the respective cleaning devices upon the color taste of an image because of the reverse transfer or the like to the respective photosensitive members. The toners of the other colors (color toners) such as yellow, magenta and cyan than black affect the color taste of the image because a relatively small amount of toner of other color is mixed therewith. Or the techniques described in the aforementioned Japanese Patent Application Laid-open No. 2001-337503 and Japanese Patent Application Laid-open No. 2003-15494 cannot be applied to a color image forming apparatus of the one-drum type. Further, according to this prior art, there is the problem that the degree of freedom of design is restricted by the necessity of disposing on the most upstream side the developing device for yellow which is low in the color mixing rate of a different color toner (the limit of the color mixing rate) with an inherent color toner when a change in the hue of the final image has reached an allowable limit level. Also, when the color mixing rate of the toners collected by the respective cleaning devices is great, there is the undesirable possibility that the consumed (recycled) amount of the toners decreases and the cleaning devices become full of the toners. Also, these prior arts do not mention the recycling of untransferred toners with the toners of four colors mixed together therein on the intermediate transfer member or the recording material conveying member.

Hereinafter, the new toner supplied to the developing device will be referred to as the "fresh toner", and the toner collected by the cleaning device and returned to the developing device and recycled thereby will be referred to as the "recycled toner".

As a result of the study assiduously made by the inventor, it has been found that it is very advantageous and very efficient to return the recycle toner with toners of plural colors mixed together collected from the photosensitive member and the image conveying members (such as the intermediate transfer member and the recording material conveying member) or the image conveying member as the black toner to the developing device for black and recycle it.

SUMMARY OF THE INVENTION

It is an object of the present invention to provide an image forming apparatus in which a toner with toners of plural colors mixed together therein collected by collecting means can be efficiently recycled and also, any change in the color taste of an image by the recycling of the toner can be prevented.

It is a further object of the present invention is to provide an image forming apparatus in which a toner with toners of plural colors mixed together therein collected by collecting means is supplied to developing means for a predetermined color and recycled, and in which toners of other colors than the predetermined color can be recycled without waste and any change in the color taste of an image by the recycling of the toners can be prevented.

An image forming apparatus for achieving the above objects has:

a plurality of developing means corresponding to a plurality of colors including at least a predetermined color for developing an electrostatic image as toner images;

an image bearing member bearing thereon the toner images developed by the plurality of developing means;

collecting means for toners residual on the image bearing member after the toner images of respective colors formed on the image bearing member have been respectively transferred to a recording material;

wherein the image forming apparatus has a relationship that of the collected toners with the plurality of colors mixed together therein collected by the collecting means, any colors except the predetermined color are mixed together at a predetermined rate to thereby provide the predetermined color in a pseudo fashion, and the collected toners and a fresh toner for the predetermined color can be supplied to the developing means for the predetermined color; and changing means for changing the mixing ratio of the collected toners and the fresh toner for the predetermined color supplied to the developing means for the predetermined color, in conformity with the ratio of the toners of respective colors constituting the toner of the pseudo predetermined color occupied in the collected toners.

Further, an image forming apparatus for achieving the above objects has:

a plurality of developing means corresponding to a plurality of colors including at least a predetermined color for developing an electrostatic image as toner images;

a plurality of image bearing members corresponding to the developing means and bearing the developed toner images thereon;

collecting means for collecting toners residual on the image bearing members after the toner images formed on the respective image bearing members have been respectively transferred onto a recording material;

wherein the image forming apparatus has relationship that of the collected toners with the plurality of colors mixed together therein collected by the collecting means, any colors except the predetermined color are mixed together at a predetermined rate to thereby provide the predetermined color in a pseudo fashion, and the collected toners and a fresh toner for the predetermined color can be supplied to the developing means for the predetermined color; and changing means for changing the mixing ratio of the collected toners and the fresh toner for the predetermined color supplied to the developing means for the predetermined color, in conformity with the ratio of the toners of respective colors constituting the toner of the pseudo predetermined color occupied in the collected toners.

Further, an image forming apparatus for achieving the above objects has:

a plurality of developing means corresponding to a plurality of colors including at least a predetermined color for developing an electrostatic image as toner images;

an image bearing member bearing therein the toner images of the respective colors in superposed relationship with one another correspondingly to the respective developing means;

collecting means for collecting toners residual on the image bearing member after the toner images formed on the image bearing member have been transferred to a recording material;

wherein the image forming apparatus has a relationship that of the collected toners with the plurality of colors mixed together therein collected by the collecting means, any colors except the predetermined color are mixed together at a predetermined rate to thereby provide the predetermined color in a pseudo fashion, and the collected toners and a fresh toner for the predetermined color can be supplied to the developing means for the predetermined color; and changing means for changing the mixing ratio of the collected toners and the fresh toner for the predetermined color supplied to the developing means for the predetermined color, in conformity with the ratio of the toners of respective colors constituting the toner of the pseudo predetermined color occupied in the collected toners.

Further, an image forming apparatus for achieving the above objects has:

a plurality of developing means corresponding to a plurality of colors including at least a predetermined color for developing an electrostatic image as toner images;

an image bearing member bearing thereon the toner images developed by the plurality of developing means;

an intermediate transfer member onto which the toner images of respective colors formed on the image bearing member are transferred;

collecting means for collecting any toners residual on the intermediate transfer member after the color images on the intermediate transfer member have been collectively transferred onto a recording material;

detecting means for detecting the ratio of the toner of the predetermined color in the collected toners collected by the collecting means; and changing means capable of supplying the collected toners and a fresh toner for the predetermined color to the developing means for the predetermined color, and changing the mixing ratio of the collected toners and the fresh toner for the predetermined color supplied to the developing means for the predetermined color, in conformity with the result of detection by the detecting means.

Further, an image forming apparatus for achieving the above objects has:

a plurality of developing means corresponding to a plurality of colors including at least a predetermined color for developing an electrostatic image as toner images;

a plurality of image bearing members corresponding to the respective developing means and bearing the developed toner images thereon;

an intermediate transfer member onto which the toner images of the respective colors formed on the plurality of image bearing members are transferred;

collecting means for collecting any toners residual on the intermediate transfer member after the color images on the intermediate transfer material have been collectively transferred onto a recording material;

detecting means for detecting the ratio of the toner of the predetermined color in the collected toners collected by the collecting means; and changing means capable of supplying the collected toners and a fresh toner for the predetermined color to the developing means for the predetermined color, and changing the mixing ratio of the collected toners and the fresh toner for the predetermined color supplied to the developing means for the predetermined color, in conformity with the result of detection by the detecting means.

DESCRIPTION OF THE PREFERRED EMBODIMENTS

Some embodiments of an image forming apparatus according to the present invention will hereinafter be described in greater detail with reference to the drawings.

Embodiment 1

(General Construction and Operation of the Image Forming Apparatus)

Figure 1:
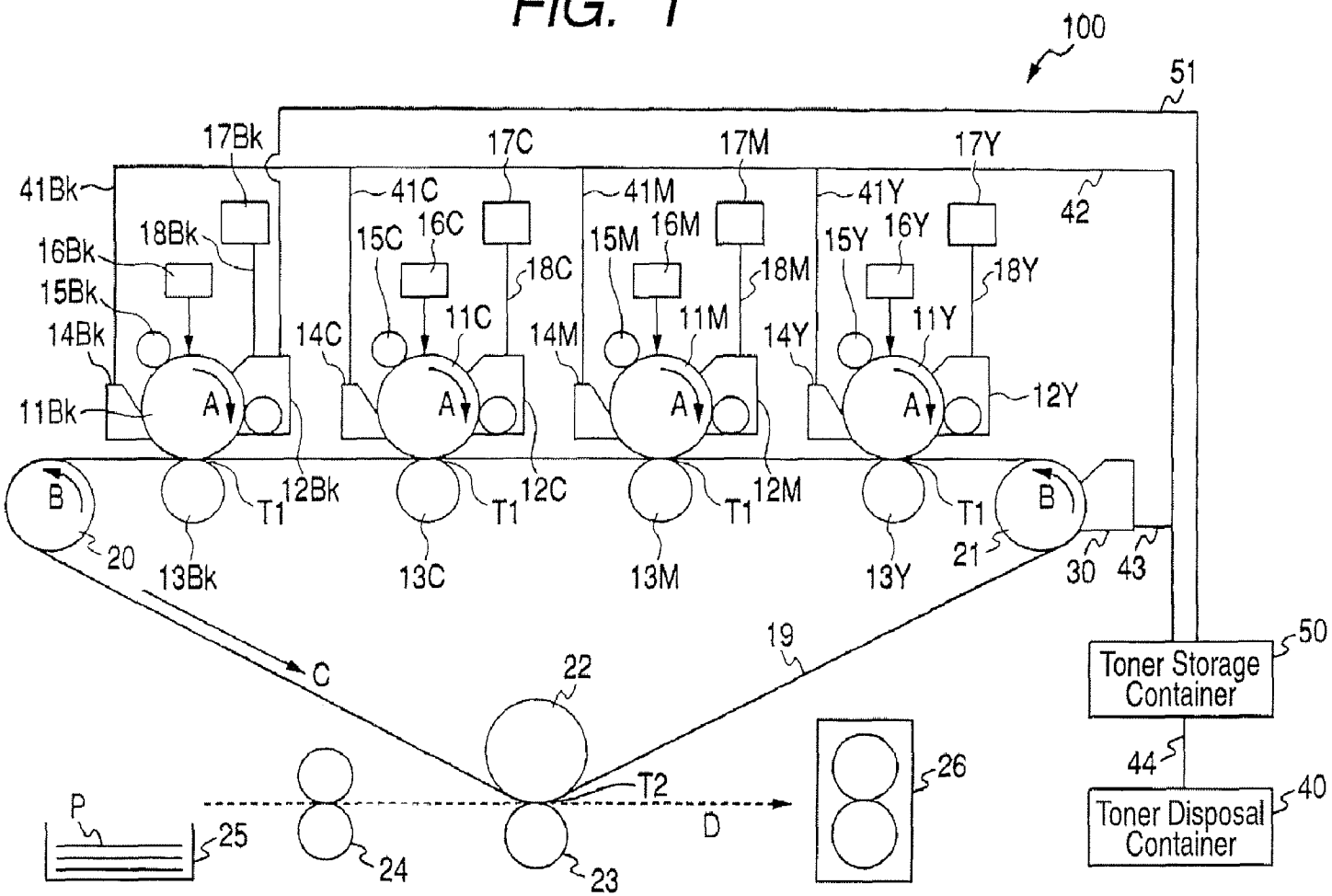
FIG. 1 is a typical cross-sectional view of an embodiment of an image forming apparatus according to the present invention.

FIG. 1 schematically shows the construction of an embodiment of the image forming apparatus according to the present invention. The image forming apparatus according to the present embodiment is a color laser beam printer (hereinafter simply referred to as the "image forming apparatus") 100 capable of forming a four-color full-color image which adopts an intermediate transferring process of the tandem type.

The image forming apparatus shown in FIG. 1 has, as image forming means, four image forming units (first, second, third and fourth image forming units) PY, PM, PC and PBk for forming toner images of four different colors (yellow (Y), magenta (M), cyan (C) and black (Bk)) arranged in juxtaposed relationship with one another. An intermediate transfer member (intermediate transfer belt) 19 as an image bearing member is disposed in such a manner as to longitudinally pass through these image forming units.

These four image forming units are similar in construction to one another and hereinafter, the construction of the yellow (Y) image forming unit PY will be described as a representative.

As an image bearing member, for example, a cylindrically shaped electrophotographic photosensitive member (hereinafter referred to as the "photosensitive drum") 11Y having a surface layer formed of an organic photoconductor (OPC) is rotatively driven in the direction of arrow A. A charging roller as charging means for uniformly charging the surface of the photosensitive drum 11Y has a predetermined bias applied thereto, and is driven to rotate by the photosensitive drum 11Y and charges the surface of the photosensitive drum 11Y to predetermined potential. The charged photosensitive drum 11Y is subjected to exposure light (in the present embodiment, a laser beam) by an exposing device 16Y, whereby an electrostatic latent image corresponding to the color-resolved image of an input original is formed on the photosensitive drum 11Y. Then, a developing device 12Y as developing means effects development by the use of a charged toner to thereby form a toner image corresponding to the electrostatic latent image on the surface of the photosensitive drum 11Y. The toner image on the photosensitive drum 11Y is primary-transferred onto the intermediate transfer belt 19 as an image bearing member rotated substantially at the same speed as the photosensitive drum 11Y, by a primary transfer roller 13Y as primary transferring means to which a predetermined bias is applied.

The intermediate transfer belt 19 is passed over a drive roller 20, a supporting roller 21 and a back-up roller 22 as a plurality of rollers, and is driven by the rotation of the drive roller 20 in the direction of arrow B while contacting with the respective photosensitive drums 11Y, 11M, 11C and 11Bk of the image forming units PY, PM, PC and PBk, and is moved round in the direction of arrow C. The intermediate transfer belt 19 is nipped between primary transfer rollers 13Y, 13M, 13C, 13Bk and photosensitive drums 11Y, 11M, 11C, 11Bk, whereby primary transfer nip parts (primary transferring parts) T1 are formed between the photosensitive drums 11Y, 11M, 11C, 11Bk and the intermediate transfer belt 19. The intermediate transfer belt 19 constitutes an image conveying member for conveying the toner images received from the image forming means provided with the photosensitive drums, the charging rollers, the exposing devices, the developing devices, the primary transfer rollers, etc. and forming on the photosensitive drums the toner images to be transferred to the transfer member.

The above-described operation is performed by the image forming units PY, PM, PC and PBk, and the toner images formed on the photosensitive drums 11Y, 11M, 11C and 11Bk are multiplexly transferred onto the intermediate transfer belt 19 in order respsectively. In the case of a full-color mode, the toner images of the respective colors are primary-transferred onto the intermediate transfer belt 19 in the order of Y, M, C and Bk (the order of colors may be arbitrary depending on the image forming apparatus), and also in the case of a single-color or 2- to 3-color mode, the toners of necessary colors are multiplexly transferred onto the intermediate transfer belt 19 by a process similar to that described previously.

Then, for the multiplexly transferred toner images, a recording material P taken out of a cassette 25 as a recording material containing portion is supplied to a secondary transfer nip part (secondary transferring part) T2 in which the back-up roller 22 and a secondary transfer roller 23 as secondary transferring means contact with each other at predetermined time by a pair of registration rollers through the intermediary of the intermediate transfer belt 19. Thus, the toner images on the intermediate transfer belt 19 are secondary-transferred onto the recording material P by the secondary transfer roller 23 to which a predetermined bias is applied. The recording material P to which the toner images have been secondary-transferred is conveyed on a conveying route indicated by broken line D. The recording material P is conveyed to a fixing device 26, and the toner images on the recording material P are pressurized and heated by the fixing device 26, and are fixed on the recording material P.

On the other hand, any untransferred toner (primary-untransferred toner) residual on the photosensitive drum 11Y after the primary transferring step is collected by first cleaning means (a photosensitive drum cleaning device (first cleaning device)) 14Y as collecting means. A blade or a brush or the like as a cleaning member is disposed on the first cleaning device 14Y. The photosensitive drum 11Y from which the primary-untransferred toner has been removed is uniformly charged again by the charging roller 15Y and becomes ready for the next image forming. This also holds true of the other image forming units.

Also, any untransferred toners (secondary-untransferred toners) residual on the intermediate transfer belt 19 after the secondary transferring step are collected by an intermediate transfer member cleaning device (second cleaning device) 30 as second cleaning means. A blade or a brush or the like as a cleaning member is disposed on the second cleaning device 30. The intermediate transfer belt 19 from which the secondary-untransferred toners have been removed is used for primary transfer in the next image formation. The second cleaning device 30 is provided between the secondary transferring part T2 and the first image forming unit PY, in opposed relationship with the supporting roller 21 in the present embodiment, in the moving direction of the intermediate transfer belt 19 indicated by arrow C.

In the present embodiment, each of the developing devices 12Y, 12M, 12C and 12Bk for yellow, magenta, cyan and black provided in the image forming units PY, PM, PC and PBk, respectively, is two-component developing means using a so-called two-component developer provided chiefly with toner particles (toner) and carrier particles (carrier) as a developer. Design is made such that image forming is effected while an amount of toner controlled so that the carrier and the toner may always assume a substantially constant mixing ratio, and substantially equal to the amount of consumed toner is being supplied to each of the developing devices 12Y, 12M, 12C and 12Bk. The details of the supply of the toners to the developing devices 12Y, 12M, 12C and 12Bk will be described later.

(Toner Recycle)

Description will now be made of the recycling of the toners which is most characteristic in the present embodiment. In the ensuing description, regarding the toners, the ratio (the mixing ratio or the like) is represented by a percentage at weight [g] (wt %). Also, the mixing ratio of the actual toners was measured by the recycled toner ratio of the supplemental toner (collected toner ratio) [wt %]=(recycled toner amount [g]/total supplemental toner amount [g])×100. The total supplemental toner amount [g]=recycled toner [g]+fresh toner [g]. Also, in the present embodiment, the specific gravities of the toners of the respective colors are substantially the same.

In the image forming apparatus according to the present embodiment, the toners collected by the first cleaning devices 14Y, 14M, 14C and 14Bk are carried first collected toner carrying machines 41Y, 41M, 41C and 41Bk as toner carrying means communicating with the first cleaning means 14Y, 14M, 14C and 14Bk of the respective image forming units PY, PM, PC and PBk, and are collected as recycled toners in a toner storage container 50 as recycled toner storage means by a second collected toner carrying machine 42 communicating with the first collected toner carrying machines 41Y, 41M, 41C and 41Bk.

The toners collected by a second cleaning device 30 as collecting means are carried by a third collected toner carrying machine 43 as toner carrying means communicating with the second cleaning device 30 and the second collected toner carrying machine 42, and are collected as the recycled toners in the toner storage container 50 by the second collected toner carrying machine 42.

The construction of the toner storage container 50 will be described later in detail. Also, as each of the first, second and third collected toner carrying machines 41 (41Y, 41M, 41C, 41Bk), 42 and 43, in the present embodiment, use is made of a screw conveyor having, in the interior of a cylindrical member, a rotary shaft and a vane provided in a spiral shape along this rotary shaft.

The recycled toner with the toners of plural colors mixed together (in the present embodiment, usually the toners of four colors, i.e., yellow, magenta, cyan and black, are mixedly present, but at the early stage of use, there may be a case where the toner of any one color is not mixedly present) collected into the toner storage container 50 is carried to the black developing device 12Bk by a recycled toner carrying machine 51 as toner carrying means. Then, it is mixed with a black fresh toner supplied from a toner supplying container 17Bk as fresh toner supplying means to the developing device for black (hereinafter referred to also as the "black developing device") 12Bk as toner carrying means, and is recycled.

According to the inventor's study, the construction in which the recycled toner with the toners of plural colors mixed together is supplied to the black developing device 12Bk and is recycled, as compared with a construction in which the recycled toner with the toners of plural colors mixed together is supplied to the developing devices of the other colors than the black developing device 12Bk (in the present embodiment, the developing devices 12Y, 12M and 12C for yellow, magenta and cyan, and hereinafter referred to also as "the yellow developing device", "the magenta developing device" and "the cyan developing device"), and is recycled, is highest in the recycling efficiency of the recycled toner within a range in which the color taste of an image is not changed (a range in which any change in the color taste will pose no problem in visual perception).

Describing the reason for this, the color taste is represented by three dimensions, i.e., luminosity, chroma and hue. Although depending on the toner material, generally, when a monochromatic image is formed on paper by the same amount of toner, what is highest in luminosity and chroma is a yellow (Y) toner image, and subsequently a magenta (M) toner image≈a cyan (C) toner image, and what is lowest is a black (Bk) toner image. Consequently, regarding a change in color taste when a toner of other color gets mixed, the Y toner which is highest in luminosity and chroma is greatest in the change in color taste, and subsequently the M toner≈the C toner comes, and the Bk toner becomes small in the change in color taste. Accordingly, within a range in which the color taste of the image is not changed, the black developing device 12Bk is highest in the recycling efficiency of the recycled toner, and next comes the cyan developing device 12C≈the magenta developing device 12M, and the yellow developing device 12Y is lowest in the recycling efficiency of the recycled toner. The detailed result of the study will be described later.

Also, when the developing device of other color than the black developing device 12Bk is supplied with a toner of other color than the color inherent to that developing device, the color taste is greatly changed. Therefore, the recycled toner should desirably be recycled in the black developing device 12Bk. While in the present embodiment, a case where the recycled toner is recycled in the black developing device will be described as an example, this is not restrictive, but the recycled toner is also applicable to the developing devices of other colors than black.

Also, it has been found that to recycle, as the recycled toner, particularly the toner collected from on the image conveying member such as the intermediate transfer member or the recording material conveying member which receives the toner image formed by the image forming means, if the mixing ratio of the fresh toner and the recycled toner to be supplied to the developing device for black is made constant, there is the problem that not only the toner cannot be efficiently recycled, but also the effect for a reduction in the consumed amount of black fresh toner (low running cost) and a reduction in the interchange frequency of the toner disposal means (consideration to the environment) becomes very small.

So, in the present embodiment, the recycled toners with the toners of plural colors mixed together therein collected by the first cleaning devices 14Y, 14M, 14C, 14Bk and the second cleaning device 30, or the second cleaning device 30 are returned to the black developing device 12Bk and are mixed with the black fresh toner to be supplied to the black developing device 12Bk and are recycled and also, the ratio of the toners of the respective colors in the recycled toner is detected by toner ratio detecting means, and the mixing ratio of the recycled toner and the black fresh toner to be supplied to the black developing device 12Bk is made variable in conformity with the Bk toner ratio in the recycled toner calculated from the Bk toner ratio in the black developing device 12Bk and the detected each color toner ratio in the recycled toner.

The developing devices 12Y, 12M and 12C for yellow, magenta and cyan are controlled so that the carrier and the toner may always assume a substantially constant mixing ratio. That is, image forming is effected while toners substantially equal in amount to the consumed toners are newly supplied from toner supplying containers 17Y, 17M and 17C to the respective developing devices 12Y, 12M and 12C by fresh toner carrying machines 18Y, 18M and 18C as toner carrying means.

Here, the toner supply control itself can be effected by toner supply controlling means (ATR) well known to those skilled in the art. That is, there is known a method of directly detecting the toner density (usually the rate of the toner to the total amount of toner and carrier) in the developing device, by toner density detecting means such as an inductance sensor or an optical sensor), or, indirectly detecting the toner density as by finding the consumed amount of toner from the signal of an image formed, or combining these to thereby detect the toner density, and supplying an amount of toner substantially corresponding to the consumed toner (in some cases, a small amount of carrier is supplied at the same time) to the developing device at a suitable time.

In the present embodiment, the toner supply controlling means calculates the amount of consumed toner by the following video count process, and supplies supplemental toners to the developing devices 12Y, 12M, 12C and 12Bk. That is, from an image signal which color-resolves an image into respective toner colors (in the present embodiment, four colors), and forms an image of each toner color, it integrates the numerical value of density data (absence of toner=0, 50% halftone=128, solid image=256, linear shape) divided into 256 for each pixel (one dot) of the image by an amount corresponding to one sheet (corresponding to one page), and calculates the video count value corresponding to one sheet of each toner color. Next, it calculates the toner supply amount (≈the toner consumption amount) from the integrated video count value corresponding to the aforementioned one sheet. Then, during the image formation of the next page, it supplies the toner supply amounts of the respective toner colors calculated in the above-described manner to the developing devices 12Y, 12M, 12C and 12Bk for the respective toner colors.

Figure 8:
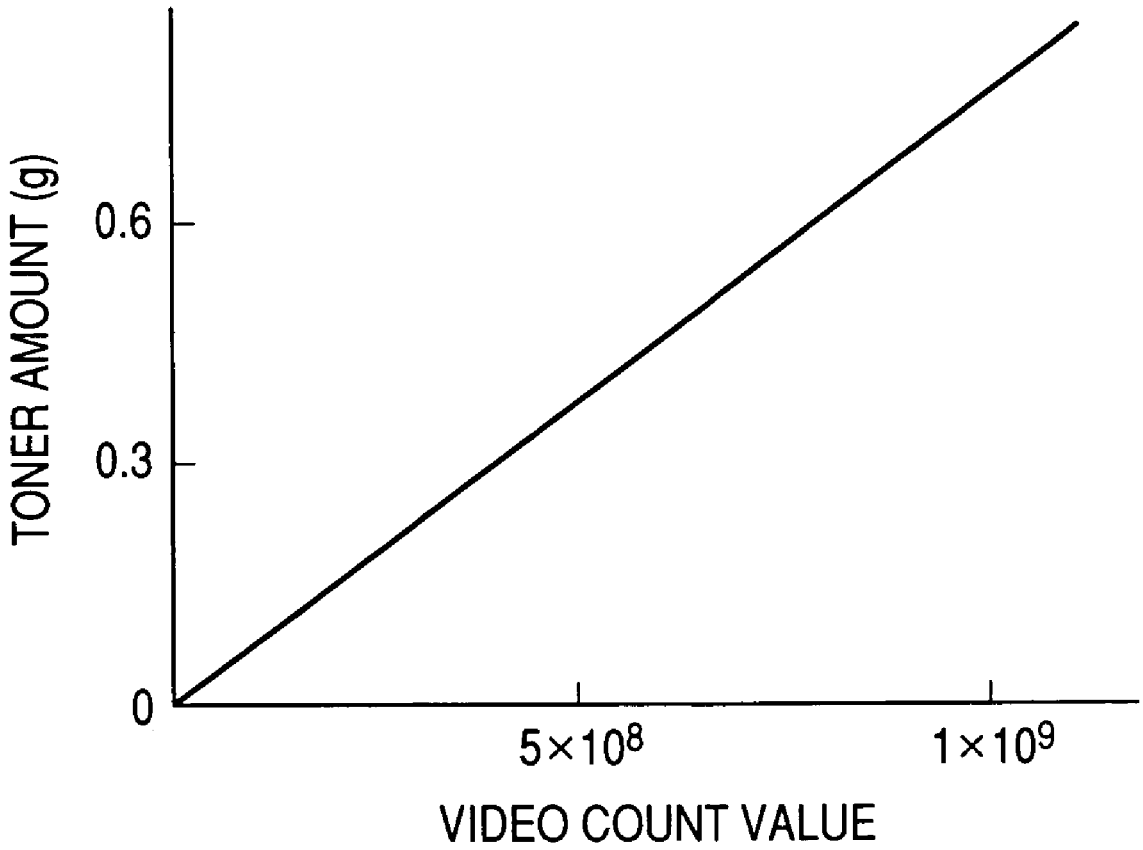
FIG. 8 is a graph showing an example of the calculation of a toner amount relative to a video count value.

FIG. 8 shows, as an example adopted in the present embodiment, a case where during the formation of a toner monochrome solid image from 600 dpi, primary transfer efficiency=90%, secondary transfer efficiency=85%, in order to provide a toner adhering amount onto the recording material≈0.5 [mg/cm$^2$], a toner adhering amount onto the photosensitive drum≈0.65 [mg/cm$^2$] was provided. For example, the video count value of one sheet of A4 paper whole solid image (having a blank of 5 mm at the edge portion of the paper)≈4.8 hundred million, and at this time, from FIG. 8, the toner supply amount≈0.37 [g].

FIG. 8 is an example, and in the present embodiment, calculation is effected by the use of the same graph of FIG. 8 for each toner color. However, this is not restrictive, but the toner supply amount may be arbitrarily set by the image forming apparatus, and the toner supply amount may be calculated by the use of discrete graphs in conformity with the respective toner colors.

Further, in the present embodiment, there is disposed an inductance sensor for detecting permeability which changes in conformity with the mixing ratio of the toner and the carrier in each of the developing devices 12Y, 12M, 12C and 12Bk. The upper limit value and lower limit value of predetermined permeability are set, and design is made such that when the upper limit value and lower limit value are detected, a predetermined toner amount (or a toner amount conforming to a predetermined video count value) is supplied to each of the developing devices 12Y, 12M, 12C and 12Bk, or the toner supply according to the video count value is inhibited. Thereby, the toner carrying means is operated so as to provide a proper mixing ratio of the toner and carrier (proper permeability) to thereby correct the error of the toner consumption amount (≈toner supply amount) by the calculation of the aforedescribed video count process and the actual toner consumption amount (≈toner supply amount. As described above, in the present embodiment, the toner consumption amount is detected by the combined process of the video count process and the inductance sensor process to thereby supply the toner to each developing device. The video count process operates for each sheet (each page), while the inductance sensor process operates only when an error occurs to the calculated value and the actual value and therefore, the inductance sensor process operates usually at a frequency of once per several hundreds to several thousands of sheets, and serves to correct the video count process.

In the present embodiment, as the fresh toner carrying machines 18Y, 18M, 18C, 18Bk and the recycled toner carrying machine 51, use is made of screw conveyors each having, in the interior of a cylindrical member, a rotary shaft and a vane provided in a spiral shape along this rotary shaft, like the first, second and third collected toner carrying machines 41 (41Y, 41M, 41C, 41Bk), 42 and 43. Here, the first, second and third collected toner carrying machines 41 (41Y, 41M, 41C, 41Bk), 42 and 43 may only have the function of carrying the toners to the toner storage container 50, but the fresh toner carrying machines 18Y, 18M, 18C, 18Bk and the recycled toner carrying machine 51 need to have the toner carrying function as well as the function of carrying a toner amount equal to the toner consumption amount to each developing device. Therefore, the fresh toner carrying machines 18Y, 18M, 18C, 18Bk and the recycled toner carrying machine 51 are designed such that the screw pitch interval is made smaller, e.g. X[g] for one full rotation (in the present embodiment, one full rotation=0.1 g), and are of a construction in which as a motor for rotating the aforementioned rotary shaft, use is made of a motor of higher accuracy (higher performance) so as to be capable of being accurately stopped at a predetermined position of 1/y rotation.

In the present embodiment the fresh toner and the recycled toner are supplied to the black developing device 12Bk in a manner described below in detail.

In the present embodiment, the new toners supplied from the toner supplying containers 17Y, 17M, 17C, 17Bk to the developing devices 12Y, 12M, 12C, 12Bk by the fresh toner carrying machines 18Y, 18M, 18C, 18Bk are the "fresh toners", and the used toner collected by each cleaning device and stored in the toner storage container 50, and also returned from there to the black developing device Bk through the recycled toner carrying machine 51 and recycled is the "recycled toner". Also, here, irrespective of being the recycled toner or the fresh toner or being a mixture of these, the toner supplied to the developing device in an amount corresponding to the consumed toner by the above-described toner supply controlling means is referred to as the "supplemental toner".

(Recycling Control of the Recycled Toner)

Description will now be further made of a recycled toner recycling controlling method of controlling a black image developed by the black developing device 12Bk so as not to spoil its color taste, in accordance with the present invention.

(Ratio of Each Color Toner in the Recycled Toner)

Description will first be made of a method of detecting the ratio of each color toner in the recycled toner.

In the present embodiment, the ratios of images of respective colors (in the present embodiment, four colors Y, M, C and Bk) are detected from the respective color density data of the image data which effect image formation, to thereby detect the ratio of each color toner in the recycled toner collected in the toner storage container 50.

(1) Primary-Untransferred Toners

In the present embodiment, the primary transfer efficiency of the Y, M, C and Bk toners is nearly 90% and substantially equal. This primary transfer efficiency somewhat fluctuates in conformity with the environment (temperature and humidity), but the deviation of the primary transfer efficiency for each color is small and substantially equal. Accordingly, the ratio of each color toner in the toners with the primary-untransferred toners mixed together therein collected by the first cleaning devices 14Y, 14M, 14C and 14Bk substantially coincides with the ratio of each color image of the image data.

(2) Secondary-Untransferred Toner

Also, in the present embodiment, the secondary transfer efficiency is of the order of 85% and substantially equal in a single toner color of each of Y, M, C and Bk. This secondary transfer efficiency somewhat fluctuates in conformity with the environment (temperature and humidity), but the deviation of the secondary transfer efficiency of each single toner color is small and substantially equal.

However, in the color images multiplexly transferred onto the intermediate transfer belt 19, it is difficult for the toner on the intermediate transfer belt 19 side (the uppermost layer toner in a case where the color images have been secondary-transferred onto the recording material P) to be secondary-transferred to the recording material. Therefore, the secondary transfer efficiency of each color in the color images assumes a somewhat different value, depending on the order of the colors of the formed color image, i.e., the toners superposed one upon another on the intermediate transfer belt 19. Accordingly, the ratio of each color toner in the secondary-transferred toners collected by the second cleaning device 30 causes some deviation relative to the ratio of each color image of the image data.

According to the inventor's study, however, this deviation is usually within an error range from the viewpoint of the color taste of the image formed by the use of the recycled toners, and further, in practical use, this deviation is averaged because various colors are formed into an image and therefore, the ratio of each color toner in the recycled toners collected by the second cleaning device 30 substantially coincides with the ratio of each color image by the image data and therefore, can be replaced by the ratio of each color image of the image data.

Here, in the present embodiment, the ratio of each color image by the image data is calculated by detecting the density data of each color-resolved color of the image data inputted to the image forming apparatus. More specifically, the image is color-resolved into respective toner colors (in the present embodiment, four colors), and from an image signal forming images of the respective toner colors, the numerical value of density data (absence of toner=0, 50% halftone=128, solid image=256, linear shape) divided into 256 for each pixel (one dot) of the image is integrated by an amount corresponding to one sheet (corresponding to one page) to thereby calculate the video count value corresponding to one sheet of each toner color. Next, the ratio of each color image corresponding to one sheet is calculated by the sum total of the video count values corresponding to one sheet of the above-mentioned each toner color and the video count value corresponding to one sheet of the respective toner colors. That is, the ratio of each color image based on this density data is the ratio of the weight of each color toner of the image, and corresponds to the ration of the weight of each color toner in the recycled toners. Thus, there is the advantage that by detecting the ratio of each color toner in the recycled toners on the basis of the image data inputted to the image forming apparatus, it is possible to detect the ratio of each color toner easily and highly accurately.

(Mixing Ratio of the Recycled Toners and Fresh Toner)

Figure 2:
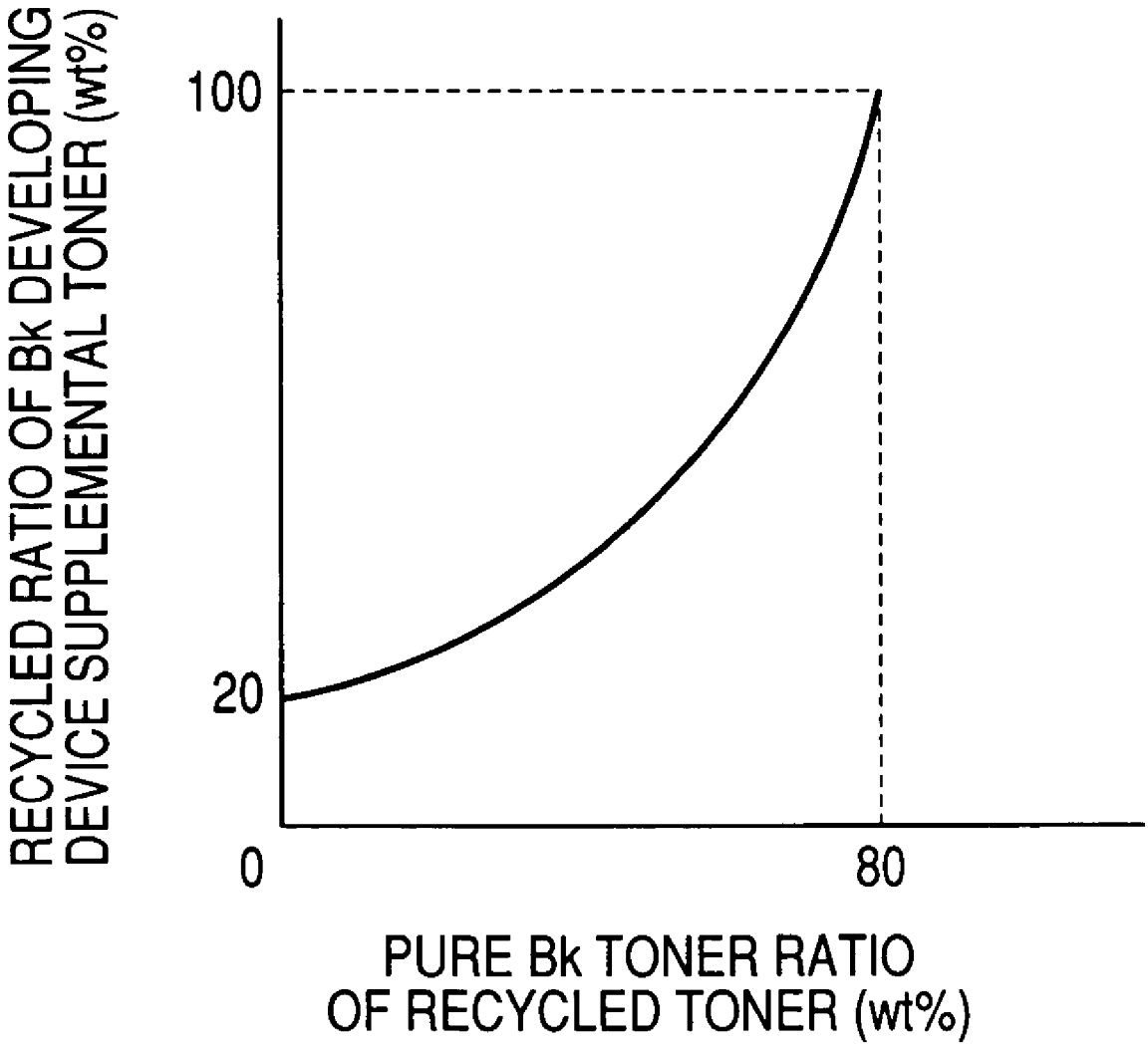
FIG. 2 is a graph showing an example of the calculation of the mixing ratio of a recycle toner and a black fresh toner in a supplemental toner supplied to a black developing device.

In the image forming apparatus according to the present embodiment, if 80 wt % or more of the toner supplied to the black developing device 12Bk is a pure black (Bk) toner (hereinafter referred to as the "pure Bk toner"), the color taste of the black image will not be spoiled whatever color may be the remaining 20 wt %. That is, the color taste of the black image will not be spoiled if the relation between the recycled toner ratio [wt %] in the supplemental toner and the pure Bk toner ration [wt %] in the recycled toners is controlled so as to be as shown in the graph of FIG. 2.

Accordingly, if the ratio of the pure Bk toner in the recycled toners is 80 wt % or greater, the color taste of the black image will not be spoiled even if the toner supplied to the black developing device 12 Bk is supplied as recycled toner 100 wt % (fresh toner 0 wt %).

When a toner of other color gets mixed with the developing means, the color taste changes, and the change in the color taste can be measured as a color difference (ΔE). Generally, the color difference (ΔE) is within the order of 6, the change in the color taste is difficult to sense at the human visual perception level. Yellow (Y), however, enables any change in the color taste to be sensed even if the color difference (ΔE) is of the order of 2 to 3.

The above-mentioned ratio 80 wt % or greater of the pure Bk toner which prevents the color taste of the black image from being spoiled is a limit value limiting the color difference (ΔE) to within 6, as a result of study made with other color toner being mixed with the pure Bk toner in the toners adopted in the present embodiment, and mixed color toners with various pure Bk toner ratios being put into the black developing device 12Bk, and a black image having been outputted by the image forming apparatus.

For reference, when similar study was made about Y toner, M toner and C toner to thereby find the ration of each pure color toner, the results were such that the limit values limiting the color difference (ΔE) to within 6 were pure Y toner ratio≈97 wt % or greater, pure M toner ratio≈pure C toner ratio≈95 wt % or greater. These results, as previously described, are the reason why the construction in which the recycled toners with toners of plural colors mixed together therein are supplied to the black developing device 12Bk and are recycled is highest in the recycling efficiency of the recycled toner within a range which does not change the color taste of the image (a range which will not pose any problem in visual perception even if the color taste changes), as compared with a construction in which the recycled toners with toners of plural colors mixed together are supplied to the developing devices of the other colors than the black developing device 12Bk (in the present embodiment, the developing devices 12Y, 12M and 12C for yellow, magenta and cyan) and are recycled.

This pure Bk toner ration 80 wt % or greater which prevents the color state of the black image from being spoiled changes in conformity with the toner material, and is an arbitrary ratio in conformity with the toner material and the image forming apparatus.

(Recycled Toner Recycling Control)

The details of a recycled toner recycling controlling method in the present embodiment will be shown below. The recycled toner recycling method according to the present invention is achieved by following any one of the following items (1) to (5) or a combination thereof. Preferably the best result is obtained by following all of these items.

(1) Initial Setting

Initial setting sets the mixing ratio of the recycled toners and fresh toner in the toner supplied to the black developing device 12Bk to the recycled toners 100 wt % (fresh toner 0 wt %). The deficiency by only the recycled toners is supplemented by the fresh toner.

That is, a character document image usually formed most often is very great in the ration of a black image. Therefore, it is preferable to make the initial setting of the image forming apparatus into the setting of the mixing ratio of the recycled toners and the fresh toner in the toner supplied to the black developing device 12Bk to the recycled toners 100 wt % (fresh toner 0 wt %), and when the toners supplied to the black developing device 12Bk are deficient by only the recycled toners, it is preferable to supplement the deficient amount with the fresh toner.

(2) Ratio of Each Color Toner in the Recycled Toners

The ratios of the Y, M, C and Bk color toners in the recycled toners collected into the toner storage container 50 in the above-described manner are detected from the ratios of the respective color images of the image data. In the present embodiment, the ratios of the respective color toners in the recycled toners are detected on the basis of the image data and therefore, the ratio of the Bk toner in the recycled toners detected here is usually not the ratio of the pure Bk toner. This is because the recycled toners are supplied to the black developing device 12Bk.

(3) Ratio of the Pure Bk Toner in the Recycled Toners

From the ratio of the Bk toner detected in accordance with the item (2) above, the ratio of the pure Bk toner in the recycled toners is calculated by the following calculating expression 1.

Detected *Bk* toner ration [wt %]×0.8=pure *Bk* toner ratio [wt %] Expression 1

Here, the ratio of the Bk toner in the recycled toners detected in accordance with the item (2) above includes the recycled toners with plural colors mixed together therein supplied to the black developing device 12Bk. Accordingly, from the data shown in the graph of FIG. 2 adopted in the present embodiment, when the mixing ratio of the recycled toners in the supplemental toner is controlled so that the pure Bk toner may be included by 80 wt % or greater in the supplemental toner, maximum 20% of the toners in the black developing device 12Bk is the toner of other color (than Bk). That is, at least 80% of the Bk toner ratio detected in accordance with the item (2) above is the pure Bk toner. Accordingly, the ratio of the Bk toner detected in accordance with the item (2) above is multiplied by 0.8 to thereby calculate the ratio of the pure Bk toner in the recycled toners. When the mixing ratio of the recycled toners in the supplemental toner is controlled so that the pure Bk toner may be included by the other ratio or greater in the supplemental toner, similar consideration can also be adopted to thereby calculate the ratio of the pure Bk toner in the recycled toners. As described above, in the present embodiment, the ratio of the pure Bk toner in the recycled toners is calculated from the result of the detection of the Bk toner ration in the black developing device and the ratio of each color image of the image data.

(4) Mixing Ratio of the Recycled Toners and Fresh Toner in the Supplemental Toner In conformity with the ratio of the pure Bk toner in the recycled toners calculated in accordance with the item (3) above, the mixing ratio of the recycled toners in the supplemental toner supplied to the black developing device 12Bk is determined from the data shown in the graph of FIG. 2. It is to be understood that the remainder of the supplemental toner is the fresh toner.

That is, the mixing ratio of the recycled toners and fresh toner in the supplemental toners is calculated by the following calculating expressions 2 and 3.

The recycled toner ratio [wt %] in the supplemental toner=20 [wt %]/(100 [wt %]−pure *Bk* toner ration [wt %]×100 (however, maximum 100 [wt %] (Expression 2)

The fresh toner ratio [wt %] in the supplemental toner=100 [wt %]−recycled toner ratio [wt %] in the supplemental toner (however, minimum 0 [wt %] (Expression 3)

(5) Toner Supply to the Black Developing Device

When the same amount of toner as the toner consumed by the black developing device 12Bk is to be supplied, the fresh toner carrying machine 18Bk and the recycled toner carrying machine 51 are operated at the mixing ration of the recycled toners and the fresh toner determined in accordance with the item (4) above to thereby supply the toner to the black developing device 12Bk. Specifically, the number of revolutions of the rotary shaft of each screw conveyor of the recycled toner carrying machine 51 and the fresh toner carrying machine 18Bk is controlled, whereby the recycled toners and fresh toner in the supplemental toner are supplied to the black developing device 12Bk so as to assume the mixing ratio determined in accordance with the item (4) above.

Here, the recycled toners and fresh toner supplied to the black developing device 12Bk are uniformly agitated by an agitating and carrying member (not shown) such as a heretofore generally used screw disposed in the black developing device 12Bk. Thereby, the Bk toner in the black developing device 12Bk is used for development as the recycled toners and fresh toner uniform in the mixing ratio. Accordingly, the uneven color taste or the like of the image is adapted to be prevented from occurring.

(Control Mode)

Figure 3:
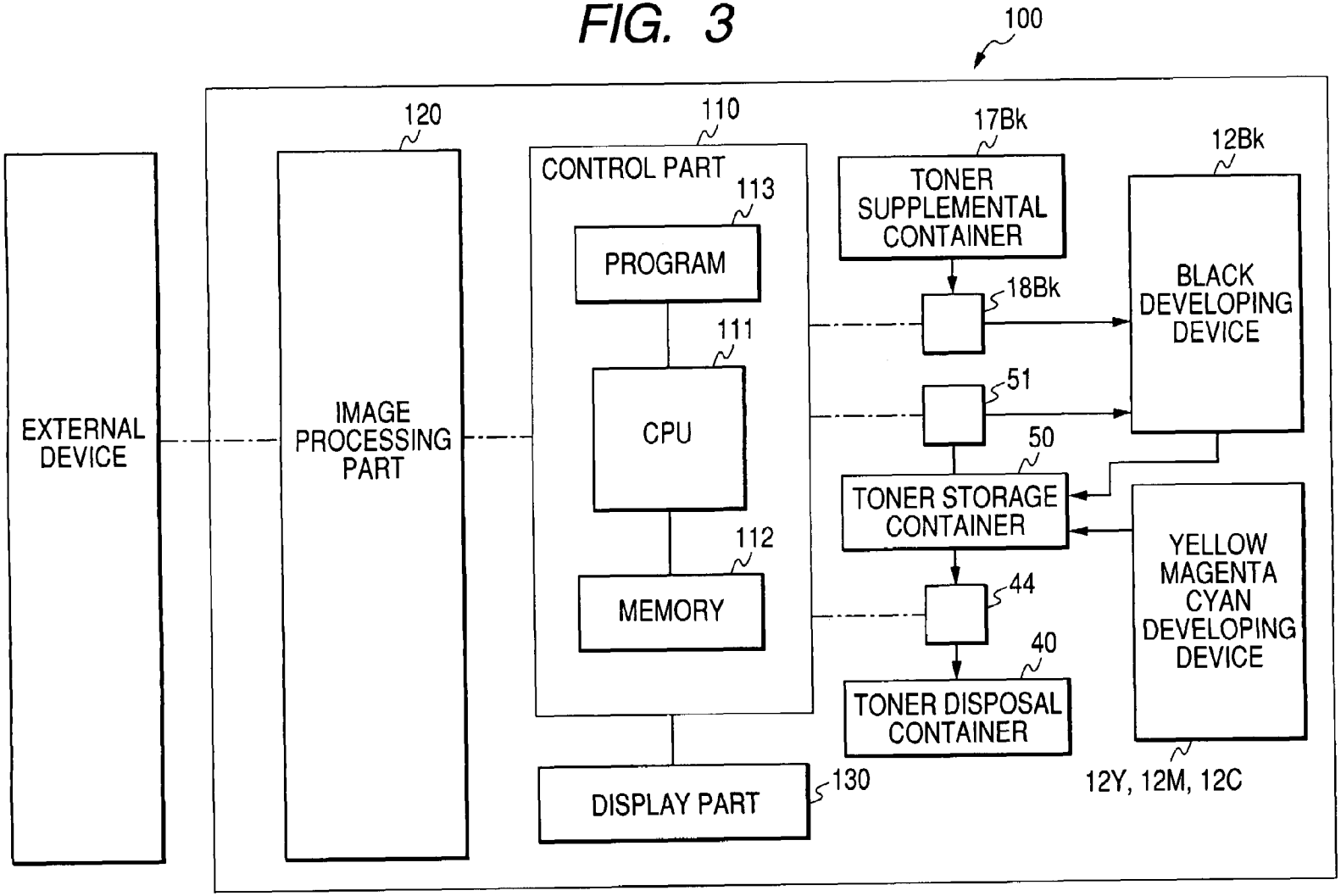
FIG. 3 is a schematic control block diagram showing a control mode of recycle toner recycling control according to the present invention.

Further describing a more specific control mode, FIG. 3 is a block diagram of a control mode of the recycling control of the recycled toners according to the present embodiment.

The image forming apparatus 100 is provided with a CPU 111 which is the central element of control, a memory (RAM) 112 as storage means used for the integration or the like of the ratio of each color toner which will be described later and a program for controlling the operation of the image forming apparatus including a recycled toner recycling process according to the present invention, and a ROM 113 in which data or the like is stored, and has a control part 110. The control part 110 sequence-operates the image forming apparatus 100 in accordance with data, a program, etc. stored in the ROM 113. Also, an image processing part 120 is connected to the control part 110, and the image processing part 120 receives an image signal from an external device such as a personal computer communicably connected to an apparatus main body or an original reading apparatus and also, transmits a signal concerned in image formation to the control part 110. The control part 110 controls the operations of the respective parts of the image forming apparatus 100 in accordance with such an image forming signal.

Particularly in the present embodiment, the CPU 111 functions as toner ration detecting means and mixing ration determining means and also, functions as toner supply controlling means, and controls toner supply to the developing devices 12Y, 12M, 12C and 12Bk at any suitable time.

Further, the CPU 111 functions as toner ratio detecting means and finds the ratio of each color toner in the recycled toners from the ration of each color image of the image data from the image processing part. Although this is not restrictive, the CPU 111 finds the ratio of each color toner in the recycled toner during each image forming process.

Also, the CPU 111 functions as mixing ratio determining means which determined the mixing ration of the recycled toners and fresh toner in the supplemental toner to the black developing device 12Bk, and calculates the ration of the pure Bk toner in the recycled toner from the ratio of each color toner in the recycled toners detected in the above-described manner.

Furthermore, the CPU 111 as the mixing ratio determining means integrates, in the memory 112, the ratio of the pure Bk toner in the recycled toners temporarily stored in the toner storage container 50 which has been found in the above-described manner. Then, the CPU 111 as the mixing ration determining means uses the ratio of the pure Bk toner integrated in the memory 112 for the determination of the mixing ratio of the recycled toners and fresh toner when supplied from the toner storage container 50 to the black developing device 12Bk.

Figure 9:
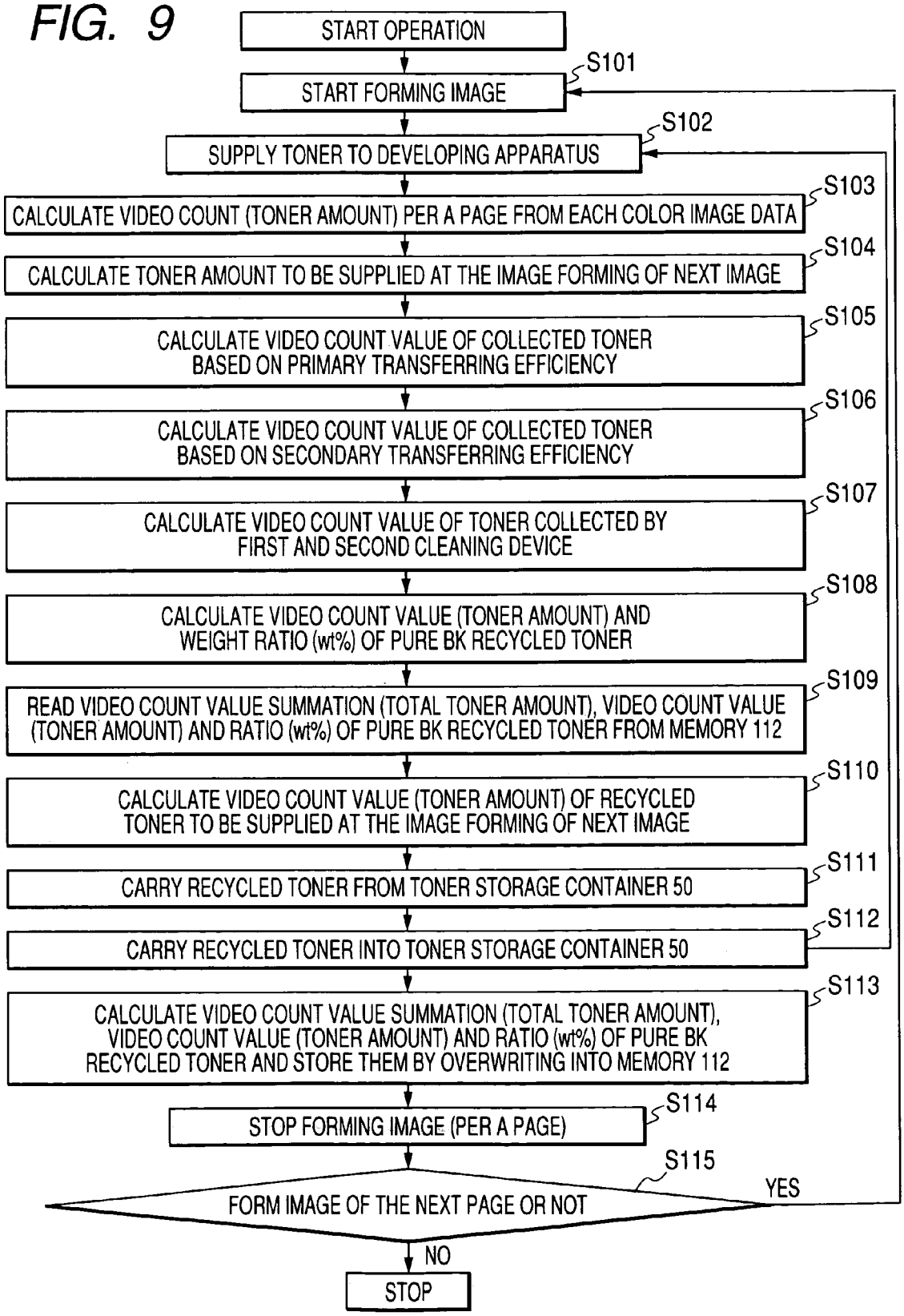
FIG. 9 is a flow chart showing the operation of Embodiment 1 of the present invention.

Here, the ratio of the pure Bk toner is integrated in the memory 112 in the following manner. The ratios of the pure Bk toner in the recycled toners carried out from the toner storage container 50 by the recycled toner carrying machine 51 and the recycled toners newly carried into the toner storage container 50 are schematically integrated to thereby always renew the ratio of the pure Bk toner in the recycled toners in the toner storage container 50. More specifically, description will be made below in detail with reference to a flow chart shown in FIG. 9.

Description will first be made in detail of a method of calculating the pure Bk toner in the recycled toners newly carried from the collected toner carrying machines 42 and 43 into the toner storage container 50. First, image forming corresponding to one page is started (S101) A toner amount corresponding to the amount of toner consumed for the preceding page is supplied to the developing apparatus (S102).

The image is color-resolved into respective toner colors (four colors in the present embodiment), and from image signal data forming an image of each toner color, the numerical data of density data (absence of toner=0, 50% halftone=128, solid image=256, linear shape) divided into 256 for each pixel (each dot) of the image is integrated by an amount corresponding to one sheet (one page) to thereby calculate video count values BY, BM, BC and BBk corresponding to one sheet of the respective toner colors, and the video count sum total value BA corresponding to one sheet=BY+BM+BC+BBk (S103).

Accordingly, the video count values of the toners used for development on the photosensitive drums 11Y, 11M, 11C and 11Bk by the developing devices 12Y, 12M, 12C and 12Bk in a one-sheet image forming operation are BY, BM, BC and BBk.

At this time, by the graph shown in FIG. 8, the video count values (toner amounts) for the respective colors can be summed up from from toner amounts [g] corresponding to the above-mentioned video count values BY, and BBk corresponding to one sheet to thereby calculate the consumed amounts [g] of the toners of the respective colors corresponding to one sheet and the same supply amounts [g] of the toners of the respective colors as those amounts (S104).

Next, of the toners used for development on the respective photosensitive drums 11Y, 11M, 11C and 11Bk, the video count values T1BY, T1BM, T1BC and T1Bk of the collected primary-untransferred toners sent to the photosensitive drum cleaning devices 14Y, 14M, 14 and 14Bk are calculated as follows by the used of the primary transfer efficiency=90% as described above (S105).

$$\text{Primary-untransferred } Y \text{ toner } T1BY=BY\times 0.1$$

$$\text{Primary-untransferred } M \text{ toner } T1BM=BM\times 0.1$$

$$\text{Primary-untransferred } C \text{ toner } T1BC=BC\times 0.1$$

$$\text{Primary-untransferred } Bk \text{ toner } T1Bk=BBk\times 0.1$$

Also, of the toners primary-transferred onto the intermediate transfer belt 19, the video count values T2BY, T2BM, T2BC and T2Bk of the secondary-untransferred toners sent to the intermediate transfer member cleaning device 30 are calculated as follows by the use of the secondary transfer efficiency=85% as described above (S106).

Secondary-untransferred $Y$ toner $T2BY[g]=(BY\times0.9)\times0.15$

Secondary-untransferred $M$ toner $T2BM[g]=(BM\times0.9)\times0.15$

Secondary-untransferred $C$ toner $T2BC[g]=(BC\times0.9)\times0.15$

Secondary-untransferred $Bk$ toner $T2BBk[g]=(BBk\times0.9)\times0.15$

Respective video count values KBY, KBM, KBC and KBBk corresponding to the toner amounts of the respective recycled toners collected by the first and second cleaning devices and carried into the toner storage container 50 during one image forming operation are calculated as follows (S107).

Carried-in $Y$ toner $KBY=T1BY+T2BY$

Carried-in $M$ toner $KBM=T1BM+T2BM$

Carried-in $C$ toner $KBC=T1BC+T2BC$

Carried-in $Bk$ toner $KBBk=T1BBk+T2BBk$

The video count sum total value BIN of the recycled toners carried into the toner storage container 50 during one image forming operation and the pure Bk toner ratio [wt %] are calculated as follows (S108).

The carried-in toner sum total value RIN is calculated by BIN=KBY+KBM+KBC+KBBk.

Accordingly, the video count value KPBBk of the carried-in pure Bk toner in the recycled toner (carried-in Bk toner) carried into the toner storage container 50 during one image forming operation is calculated by Pure $Bk$ toner $KPBBk$ in carried-in $Bk$ toner$=KBBk\times0.8$ because maximum 20% of the toner in the black developing device 12Bk is toners of other colors (than Bk) (S108).

Consequently, the carried-in pure Bk toner ration [wt %] in the recycled toners carried into the toner storage container 50 during one (one page) image forming operation is calculated by carried-in pure $Bk$ toner ratio [wt %]$=(KPBBk/BIN)\times100$ (S108).

(here, in a case where the toner storage container 50 is not disposed, but the recycled toner is directly carried to the black developing device 12Bk and is mixed with the fresh toner for recycling, the mixing ratio of the fresh toner and the recycled toner is determined by FIG. 2 by the use of the aforementioned carried-in pure Bk toner ratio.)

Description will now be made in detail of a method of calculating the recycled toners carried out of the toner storage container 50 by the recycled toner carrying machine 51 during an image forming operation for the next page.

In the image forming operation for the preceding page, the toner amount [g] calculated from the above-mentioned video count value BBk corresponding to one sheet is the Bk toner amount [g] consumed by the black developing device 12Bk. The same amount as this toner amount [g] is supplied as the supplemental toner (the recycled toner+the fresh toner) during the image forming operation for the next page.

The pure Bk toner ration (n−1) PBk [wt %] in the recycled toners in the toner storage container 50 before the recycled toners produced in the image forming operation for the preceding page are carried into the toner storage container 50, the video count value (n−1) PBBk of the pure Bk toner, and the video count sum total value (n−1) RBA of the recycled toners in the toner storage container 50 are read from the memory 112 (S109).

From the pure Bk toner ratio in the recycled toners in the toner storage container 50, the video count value of the recycled toner mixed with the fresh toner and supplied to the developing device 12Bk during the image forming operation for the next page is calculated (S110).

Here, from the graph of FIG. 2, the recycled toner ration (n−1)R[wt %] in the supplemental toner supplied during the image forming operation for the next page is calculated by the recycled toner ratio $(n-1)R$[wt %] in the supplental toner=20 [wt %]/(100[wt %]−$(n-1)PBk$ [wt %]×100 (however, the upper limit is 100 wt %.)

Accordingly, the carried-out recycled toner BOUT is calculated by BOUT=BBk×(n−1)R/100.

Also, the video count value BBk of the fresh toner in the supplental toner is calculated by FBBk=BBk−BOUT.

Here, the recycled toner amount [g] and the fresh toner amount [g] in the supplental toner are obtained as BOUT corresponding to the video count value and the toner amount [g] corresponding to FBBk, from the graph of FIG. 8.

Description will further be made of a method of calculating the pure Bk toner ration (n) PBk [wt %] in the toner storage container 50 after during the image forming operation for the next page, a recycled toner amount corresponding to the video count value BOUT has been carried out of the toner storage container 50 by the recycled toner carrying machine 51 (S111), (S102), and thereafter the carried-in toner sum total value BIN for the preceding page has been carried from the collected toner carrying machines 42 and 43 into the toner storage container 50 (S112).

The pure Bk toner ratio (n) PBk [wt %] in the recycled toner in the toner storage container 50 after the recycled toner corresponding to BOUT has been carried out and the recycled toner corresponding to BIN has been carried in, the video count value (n) PBBk of the pure Bk toner, and the video count sum total value (n) RBA of the recycled toners in the toner storage container 50 are calculated as follows. First, the video count sum total value (n) RBA of the recycled toners in the toner storage container 50 is calculated by the recycled toner sum total value $(n)$ $RBA=(n-1)RBA-BOUT+BIN$.

Then, the video count value (n) PBk of the pure Bk toner is calculated by the pure $Bk$ toner $(n)$ $PBBk=(((n-1)RBA-BOUT)\times(n-1)PBk$[wt %]$\times100)+KPBBk$.

Accordingly, the pure Bk toner ratio (n) PBk [wt %] in the recycled toners in the toner storage container 50 is calculated by the pure $Bk$ toner ratio $(n)$ $PBk$[wt %]$=((n)PBBk/(n)RBA)\times100$.

Then, the pure Bk toner ration (n) PBk [wt %] in the recycled toners in the toner storage container 50, the video count value (n) PBBk of the pure Bk toner, and the video count sum total value (n) RBA of the recycled toners in the toner storage container 50 are renewed and stored in the memory 112.

This pure Bk toner ratio (n) PBk [wt %] in the recycled toners in the toner storage container 50 is further used for the calculation of the recycled toner ration in the supplemental toner when the same amount of supplemental toner as the Bk toner consumed by the image forming operation for the next page is supplied to the black developing device 12Bk during the image forming operation for the second next page.

The calculation s as described above are repeated for each sheet (each page) (S114, S115, S101), whereby the pure Bk toner ration in the recycled toners in the toner storage container 50 is always renewed.

Also, in the present construction, if the conveying routes of the recycled toner carrying machine 51 and the collected toner carrying machines 41 (41Y, 41M, 41C, 41Bk), 42 and 43 are shortened as much as the construction of the image forming apparatus allows, the error from the result of the calculation of the pure Bk toner ratio in the recycled toners in the toner storage container 50 can be made small, and this is more preferable.

As described above, the information of the ratio of the pure Bk toner as information conforming to the ration of each color toner in the recycled toners in integrated in the memory 112 as integrating means, whereby each color ratio of the recycled toners stored in the toner storage container 50 can be detected highly accurately even if the carrying-in and carrying-out of the recycled toners in the toner storage container 50 by image forming is repeated. Thereby, the mixing ratio of the recycled toner and black fresh toner in the supplemental toner supplied to the black developing device 12Bk can be controlled highly accurately, and the stability of the color taste of the black image and further, the stability of the color taste of a full-color image can be improved.

As described above, the CPU 111 functions as toner supply controlling means, and when the toner is supplied to the black developing device 12Bk, it reads out the ratio of the pure Bk toner in the recycled toners thitherto integrated in the memory 112, and determines the mixing ratio of the recycled toners and the fresh toner. Then, it controls the operations of the recycled toner carrying machine 51 and the fresh toner carrying machine 18Bk in accordance with the mixing ration thus determined, whereby at that mixing ratio, the recycled toners and the fresh toner are supplied to the black developing device 12Bk.

In the present embodiment, recycling means for the recycled toners is constituted by the CPU 111, the memory 112, the recycled toner carrying machine 51, the black toner supplying container 17Bk, the fresh toner carrying machine 18Bk, etc. functioning as toner ration detecting means, mixing ration determining mans and toner supply controlling means.

In the present embodiment, there is adopted the control of calculating the pure Bk toner ratio in the recycled toners in the toner storage container 50 on the basis of the video count value, and calculating the mixing ratio of the recycled toner and fresh toner in the supplemental toner. However, this is not restrictive, but the toner amount [g] relation to the video count value can be calculated from the relation between the count value and the toner amount [g] of FIG. 8 and therefore, there may be adopted the control of calculating the above-mentioned pure Bk toner ratio on the basis of the toner amount [g].

Also, in the present embodiment, there is adopted a construction in which the recycled toner to be used as the supplemental toner are carried out of the toner storage container 50, whereafter the collected toners are carried into the toner storage container 50. However, this is not restrictive, but depending on the image forming apparatus, there may be adopted a construction in which the collected toners are carried into the toner storage container 50, whereafter the recycled toners to be used as the supplemental toner are carried out of the toner storage container 50.

(Toner Storage Container)

Further describing the construction of the toner storage container 50, in the present embodiment, it is a frame member formed of generally used resin, and is a container having a capacity capable of storing therein recycled toners for several thousands of sheets (several thousands of pages) in ordinary use even if the recycled toners are not consumed at all, and hermetically sealed so that the toners may not scatter. by providing the toner storage container 50 for temporarily storing the recycled toners therein as described above, the recycled toners can be stored therein by an amount corresponding to some extent of capacity even during a low recycled toner consumption time such as a non-black image forming time, or conversely during a high recycled toner consumption time such as a black image forming time of a high printing rate. Thereby, the clogging of the toner carrying means with the toners due to the carrying of an excessive amount of recycled toner during the low recycled toner consumption time, and the deficiency of the recycled toner during the high recycled toner consumption time can be prevented.

Also, if there is disposed agitating means for uniformly mixing the colors of the recycled toners in the toner storage container 50, the ratio of the Bk toner in the recycled toners in the toner storage container 50 will become uniform, and more accurate recycled toner recycling control can be performed. That is, by the toners in the toner storage container being agitated, the ratio of each color toner in the toner storage container 50 can be made uniform, the mixing ratio of the recycled toner and fresh toner in the supplemental toner supplied to the black developing device 12Bk can be controlled highly accurately, and the uneven color taste in the black developing device 12Bk can be reduced, and the stability of the color taste of the black image, and further the stability of the color taste of a full-color image can be improved.

Further, as recycled toner absence detecting means, a toner detecting sensor which outputs a signal in conformity with the toner amount in the toner storage container 50 can be disposed in the toner storage container 50 or the recycled toner carrying machine 51. Design can be made such that when the CPU 111 has detected the absence of the recycled toners in the toner storage container 50 by the toner detecting sensor, it clears the integrated value of the ration of the pure Bk toner in the recycled toners integrated in the memory 112, and starts integrating again. Thereby, it becomes possible to make the error between the integrated value of the ratio of the pure Bk toner in the recycled toners stored in the memory 112 and the actual ratio of the pure Bk toner in the recycled toners small and therefore, the mixing ratio of the recycled toners and the fresh toner can be controlled more particularly. As the toner detecting sensor, utilization can be limitlessly made of what can be utilized such as an optical type sensor (for example, at least a portion of the toner storage container 50 is formed of a light transmitting material and is disposed), a piezo sensor (a piezoelectric element), or a capacitance sensor (for example, a bias is applied to between two antennae to thereby detect the capacitance between the antennae). Here, the absence of the toner does not mean only that the toners in the toner storage container 50 have become completely absent, but design may be made such that it is detected by the toner detecting sensor that the recycled toners in the toner storage container 50 have been decreased to a preset predetermined amount.

Also, if there is adopted a construction in which when the recycled toners are carried from the toner storage container 50 to the recycled toner carrying machine 51, meshes or the like are disposed in the carrying route to thereby remove paper dust, foreign substances or the like in the recycled toners, any defective image or a faulty image such as a streak can be prevented during the development in the black developing device 12Bk and therefore, this is more preferable.

(Toner Disposal Container)

Also, it is supposed that depending on the images, the toner storage container 50 having a certain extent of capacity becomes full of the recycled toners. Therefore, in the present embodiment, when the toner storage container 50 is full of the recycled toners, the recycled toners are carried from the toner storage container 50 to the toner disposal container 40 by an excess toner carrying machine 44 as toner carrying means. For this purpose, a toner detecting sensor which outputs a signal in conformity with the toner amount in the toner storage container 50 can be disposed as storage means fullness detecting means in the toner storage container 50. As the toner detecting means, utilization can be made of what is similar to the above-described recycle toner absence detecting means. Here, being full of the toners does not mean only that the toner storage container 50 is completely filled with the toners, but design may be made such that it is detected by the toner detecting sensor that the recycled toners in the toner storage container 50 have increased to a preset predetermined amount. When the CPU 111 detects by the toner detecting sensor that the toner storage container 50 is full, it controls the operation of the excess toner carrying machine 44 to thereby carry the recycled toners from the toner storage container 50 to the toner disposal container 40. Thereby, even during the low recycled toner consumption time such as a non-black image forming time, the supposed inconvenience that the recycled toner storing means becomes full and the toners leak or the clogging of the toner carrying means with the toners occurs can be prevented.

Also, the excess toner carrying machine 44 may be divergingly connected to the collected toner carrying machine 42 on this side of the toner storage container 50. When it is detected that the toner storage container 50 is full, the valve of the divergingly connected portion can be operated to thereby directly carry the collected toners carried by the collected toner carrying machine 42 to the toner disposal container 40 without the intermediary of the toner storage container 50.

Further, in the present embodiment, design is made such that when the toner disposal container 40 becomes filled with the toners, the image forming apparatus gives a warning to the user, and the operator disposes of the toner disposal container 40 detachable from the image forming apparatus main body and replaces it with a fresh toner disposal container 40. For this purpose, a toner detecting sensor which outputs a signal in conformity with the toner amount in the toner disposal container 40 can be disposed as disposal means fullness detecting means in the toner disposal container 40. As the toner detecting means, utilization can be made of what is similar to the above-described recycled toner absence detecting means. Here, being full of the toners does not mean only that the toner disposal container 40 is completely filled with the toners, but design may be made such that it is detected by the toner detecting sensor that the recycled toners in the toner disposal container 40 have increased to a preset predetermined amount. When the CPU 111 detects by the toner detecting sensor that the toner disposal container 40 is full, it controls so that the fact may be displaced as a warning on the display part (such as an LCD panel) of an operating portion provided as informing means on the image forming apparatus 100, or a sound such as a suitable alarm may be produced, thereby calling upon the operator to interchange the toner disposal container 40. Thereby, it becomes possible to prevent the supposed inconvenience that the toner disposal container 40 becomes full and the toners leak. In the present invention, however, the installation of such a toner disposal container 40 is not requisite.

EXAMPLES OF EXPERIMENT

In fact, the formation of various images such as documents (black-and-white images) and photographs (full-color images was effected and a test was carried out. As a comparison with the image forming apparatus according to the present embodiment, the same test was carried out by the use of a conventional image forming apparatus which does not have the toner storage container 50 and in which toners collected by the first cleaning devices 14Y, 14M, 14C and 14Bk are collected into the toner disposal container 40 as toner disposal means by the first collected toner carrying machines 41Y, 41M, 41C, 41Bk and the second toner carrying machine 42, and toners collected by the second cleaning device 30 are collected into the toner disposal container 40 by the third collected toner carrying machine 43 and the second collected toner carrying machine 42. This toner disposal container 40, when filled with the toners, is disposed of and is replaced with a fresh empty toner disposal container 40. In the other points, the construction of the conventional image forming apparatus is substantially the same as that of the present embodiment.

As a result, in the conventional image forming apparatus, the toner disposal container 40 became full of the toners for 20,000 sheets (A4 size) and it was necessary to dispose of it.

On the other hand, in the color image forming apparatus of FIG. 1 adopting the recycled toner recycling control according to the present embodiment, there was no recycled toner in the toner disposal container 40 even for 20,000 sheets (A4 size). Thereby, it has been found that in practical use, it is not necessary to interchange the toner disposal container 40, and an environmental countermeasure which does not produce waste can be realized.

Also, as compared with the conventional image forming apparatus, in the image forming apparatus adopting the recycled toner recycling control according to the present embodiment, the consumed amount of black fresh toner decreased to about 60%. Also, as regards the black image and the color image, it has been found that clear-cut images can be outputted as both with equal color tastes, and a low running cost and the stability of the color taste of image can be realized.

In the foregoing, density data of each color resulting from color-resolving an image is detected from image data for effecting image formation inputted to the image forming apparatus and the ratio of each color toner is calculated, but depending on the image forming apparatus, there may be adopted a method of detecting, from the image data outputted by the image forming apparatus, the emission time of a laser beam to which the exposing devices 16Y, 16M, 16C and 16Bk expose, and calculating the ratio of each color toner. More specifically, the laser beam emission time of each exposing device is integrated per sheet (per page) to thereby calculate the light emission time of each toner color per sheet. Next, a graph (not shown) corresponding to the axis of abscissas of the graph shown in FIG. 8 substituted for by the light emission time is discretely prepared, and the toner consumption amount (≈the toner supply amount) (of each toner color and the ratio of each color toner are calculated from the above-mentioned integrated light emission time per sheet. As described above, the ratio of each color toner in the recycled toners is detected on the basis of the image data outputted by the image forming apparatus, whereby there somewhat occurs an error when the image data inputted to the image forming apparatus is converted into output image data and therefore, as compared with the case where as described above, the ratio of each color toner is found on the basis of the image data inputted to the image forming apparatus, accuracy is somewhat lowered. However, an electric circuit which detects the ON/OFF time of a laser beam is more inexpensive than for example, an electric circuit which integration-processes density data of each 256 levels of about 1,900,000 pixels (dots) corresponding to one page of A4 paper, and can therefore be applied to a low-cost image processing system, and this leads to the advantage that detection can be accomplished easily and at a low cost.

Also, in the foregoing, the primary transfer efficiency of each color is substantially equal to that of other colors, but when depending on the image forming apparatus, the primary transfer efficiency of each color toner differs from that of other color toners, there may be adopted a construction in which the ratio of each color toner in the toners collected by the first cleaning devices 14Y, 14M, 14C and 14Bk is corrected by any calculation expression taking the primary transfer efficiency into consideration for each color image ratio of the image data. More specifically, for example, in a case where of the toners used for development on the photosensitive drums 11Y, 11M, 11C and 11Bk, the video count values T1BY, T1BM, T1BC and T1BBk of the primary-untransferred toners sent to the photosensitive drum cleaning devices 14Y, 14M, 14C and 14Bk, when the primary transfer efficiency is Y toner=90%, M toner=85%, C toner=95%, Bk toner=93%, are calculated as follows:

Primary-untransferred $Y$ toner $T1BY=BY\times 0.1$

Primary-untransferred $M$ toner $T1BM[g]=BM\times 0.15$

Primary-untransferred $C$ toner $T1BC[g]=BC\times 0.05$

Primary-untransferred $Bk$ toner $T1BBk[g]=BBk\times 0.07$

Also, in the foregoing, the secondary transfer efficiency of each color is substantially equal to that of other colors, but when depending on the image forming apparatus, the secondary transfer efficiency of each color toner differs from that of other color toners, thereby may be adopted a construction in which the ratio of each color toner in the toners collected by the second cleaning device 30 is corrected by any calculation expression taking the secondary transfer efficiency into consideration for each color image ratio of the image data. More specifically, for example, the primary transfer efficiency=90%, and of the toners primary-transferred onto the intermediate transfer belt 19, the video count values T2BY, T2BM, T2BC and T2BBk of the secondary-untransferred toners sent to the intermediate transfer member cleaning device 30, when the secondary transfer efficiency is Y toner=85%, M toner=80%, C toner=90%, Bk toner=87%, are calculated as follows:

Secondary-untransferred $Y$ toner $T2BY=(BY\times 0.9)\times 0.15$

Secondary-untransferred $M$ toner $T2BM=(BM\times 0.9)\times 0.20$

Secondary-untransferred $C$ toner $T2BC=(BC\times 0.9)\times 0.10$

Secondary-untransferred $Bk$ toner $T2BBk=(BBk\times 0.9)\times 0.13$

When depending on the colors of the image, the deviation of the secondary transfer efficiency due to the order of the colors superposed on the intermediate transfer belt 19 is great, there may be adopted a construction in which the ratio of each color toner in the toners collected by the second cleaning device 30 is corrected by any calculation expression taking the aforementioned order into consideration. More specifically, from the image data of the toner superposed portion, the area of the superposed portion is calculated, and in some cases, is multiplied by a coefficient Q(n) conforming thereto, whereby the ratio of each color toner collected by the second cleaning device 30 can be detected more accurately. When the secondary transfer efficiency greatly deviates from the aforementioned secondary transfer efficiency=85%, the amounts of secondary-untransferred toners collected by the second cleaning device 30 are calculated as follows:

Secondary-untransferred $Y$ toner $T2BY=(BY\times 0.9)\times 0.15\times Q(1)$

Secondary-untransferred $M$ toner $T2BM=(BM\times 0.9)\times 0.15\times Q(2)$

Secondary-untransferred $C$ toner $T2BC=(BC\times 0.9)\times 0.15\times Q(3)$

Secondary-untransferred $Bk$ toner $T2BBk=(BBk\times 0.9)\times 0.15\times Q(4)$ Further, as the means for detecting the ratio of each color toner in the recycled toners, resides the detecting means based on the image data, use may be made of other detecting means such as, for example, a method of detecting and calculating, although somewhat great in error, the supplemental toner amounts to be supplied to the developing devices 12Y, 12M, 12C and 12Bk, i.e., the supplemental toner amounts to be supplied from the toner supplying containers 17Y, 17M, 17C, 17Bk and the recycled toner carrying machine 51 to the developing devices 12Y, 12M, 12C and 12Bk. More specifically, for example, without the use of a video count process, the toner density (usually the rate of the toner to the total amount of the toner and the carrier) in the developing device can be directly detected by only toner density detecting means (such as an inductance sensor or an optical sensor) to thereby detect the toner consumption amount and determine the supplemental toner amount. In this case, there can be adopted a construction in which the number of revolutions of a motor which rotates the screw conveyors of the fresh toner carrying machines 18Y, 18M, 18C, 18Bk and the recycled toner carrying machine 51 is detected to thereby detect the supplemental toner amount. In a case where the ratio of each color toner in the recycled toner is detected on the basis of the toner supply amount to each developing device, as compared with the case where in the above-described manner, the ratio of each color toner in the recycled toners is calculated from the image data for effecting image formation or the image data outputted by the image forming apparatus, there is the influence of the toner supply timing or the error of the toner supply amount by the toner supply controlling means and therefore, accuracy is somewhat lowered, but there is the advantage that detection can be effected easily.

The method of detecting the ratio of each color toner in the recycled toners from the image data can detect the ratios of Y, M, C and Bk toners during each image forming time (each page). On the other hand, in the aforedescribed method of detecting the ratio of each color toner in the recycled toners from the supplemental toner amount, when the toner consumption rate is small in each developing device, toner supply is effected at a rate of one time per plural times of image formation and therefore, if averaged, the ratio of each color toner in the recycled toners becomes equal to that in the method using the image data, but time lag occurs and therefore, at real time, some error occurs.

As means for detecting the ratio of each color toner in the recycled toners, according to a method using the image data or the supplemental toner amount, there is not the necessity of disposing new detecting means in the image forming apparatus and therefore, the ratio of each color toner in the recycled toners can be detected at a low cost and highly accurately.

As has been described above, according to the recycled toner recycling control in the present embodiment, the recycled toners are recycled in the black developing device 12Bk and therefore, the consumed amount of the black fresh toner can be reduced, and the toner disposal container 40 can be eliminated or the frequency of interchange of the toner disposal container can be made very small. Thereby, a low running cost and an environmental countermeasure can be realized.

Also, the ratios of the Y, M, C and Bk color toners in the recycled toners are detected from the image data, and the ratio of the pure Bk toner is calculated, and in conformity therewith, the mixing ratio of the recycled toners and black fresh toner in the supplemental toner supplied to the black developing device 12Bk is made variable, whereby a clear-cut black image and color image can be obtained without the color taste of the black image being spoiled.

The effect of the present invention is particularly great in clerical work offices wherein the formation of black images such as documents is much required.

Further, particularly, to recycle even the toners collected from on the image conveying members such as the intermediate transfer member and the recording material conveying member which receive the toner images formed by the image forming means, if the mixing ratio of the fresh toner and the recycled toner to be supplied to the developing device for black is made constant (Japanese Patent Application Laid-open No. H8-63067 prescribes the mixing ratio of collected toners to the black toner to 60 wt % or less, and Japanese Patent Application Laid-open No. 2000-35703 supplies the black toner by a predetermined amount each time), there occurs the following inconvenience. For example, during the formation of an image of a single black color, it never happens that the color taste of the black image is spoiled and therefore, the toner to be supplied to the developing device for black may be recycled toner 100%, but only an amount of recycled toner smaller than that (e.g. 60% or a predetermined amount) can be recycled and therefore, the toner cannot be efficiently recycled. Moreover, there has been the problem that the effect for a reduction in the consumed amount of the black fresh toner (low running cost) and a reduction in the frequency of interchange of the toner disposal means (environmental consideration) becomes very small.

In contrast, in the present embodiment, during the formation of an image of a single black color, it never happens that the color taste of the black image is spoiled and therefore, the toner to be supplied to the developing device for black is recycled toner 100%, and the recycled toner can be efficiently recycled, and this leads to the possibility of providing an image forming apparatus which prevents any change in the color taste of the black image and displays the effect for a reduction in the consumed amount of the black fresh toner (low running cost) and a reduction in the frequency of interchange of the toner disposal means (environmental consideration) to its maximum.

Also, as previously described, the invention of Japanese Patent Application Laid-open No. H08-248853 has, in a one-drum type image forming apparatus (particularly, an image forming apparatus in which toner images of plural colors formed on a photosensitive member are collectively transferred to a recording material), a construction in which there are disposed two kinds of cleaning devices for the disposal and recycling, respectively, of untransferred toners, and by which of the two kinds of cleaning devices the untransferred toners on the photosensitive member should be collected is determined from the color information of written-in data in conformity with the mixing ratio of the color toners.

In contrast, in the present embodiment, the untransferred toners with a small ratio of black toner heretofore disposed of can also be recycled and therefore, any change in the color taste of the black image can be prevented to thereby recycle the recycled toners efficiently. Thereby, there can be provided an image forming apparatus which displays the effect for a reduction in the consumed amount of the black fresh toner (low running cost) and a reduction in the frequency of interchange of the toner disposal means (environmental consideration) to its maximum.

Also, as previously described, the invention of Japanese Patent Application Laid-open No. 2000-35703 has a construction which provides a developing device for a recycled developer collecting and utilizing a recycled toner which is discrete from a developing device for black. In such a construction, it is necessary to discretely dispose a developing device for the recycled developer, and this leads to a problem in downsizing and realizing a lower cost.

In contrast, in the present embodiment, it is not necessary to discretely dispose a developing device and therefore, there can be provided an image forming apparatus which realizes downsizing and a lower cost.

Also, as previously described, the invention of Japanese Patent Application Laid-open No. 2003-15494 has a construction in which in a plurality of developing devices, primary-untransferred toner is recycled by each developing device, and the mixing ratio of a fresh toner and a recycled toner to be supplied to the developing device for each color is determined on the basis of only the ratio of each color toner detected by toner ratio detecting means for detecting the ratio of each color toner in recycled toners. It has been found that in such a construction, there occurs a case where the color taste of the black image is spoiled. This is considered to be due to the fact that the toner in the developing device for black is not a pure black toner, but is a toner with other color mixed therewith. Accordingly, it is necessary to consider the ratio of the black toner in the developing device for black when determining the aforementioned mixing ratio.

In contrast, in the present embodiment, the ratio of a pure toner of an inherent color in the recycled toners is calculated from the ratio of the pure toner of the inherent color in the developing device and the image data, to thereby determine the mixing ratio of the fresh toner and the recycled toner to be supplied to the developing device. Further, in the present embodiment, by a construction in which the secondary-untransferred toners on the intermediate transfer member are also recycled as recycled toners, any change in the color taste of the black image can be prevented and the recycled toners can be efficiently recycled and therefore, there can be provided an image forming apparatus which displays the effect for a reduction in the consumed amount of the black fresh toner (low running cost) and a reduction in the frequency of interchange of the toner disposal means (environmental consideration) to its maximum.

Also, the invention of Japanese Patent Application Laid-open No. 2003-15494 has a construction which discretely dispose color mixing rate detecting means for detecting the color mixing rate of toners in developing means. Thus discretely providing the color mixing rate detecting means poses a problem to the downsizing and lower cost of an image forming apparatus main body and therefore, a construction which does not discretely provide the detecting means, but calculates the ratio of the black toner in the developing device for black is more preferable.

In contrast, in the present embodiment, it is not necessary to discretely dispose the color mixing rate detecting means for detecting the color mixing rate of the toners in the developing devices and therefore, there can be provided an image forming apparatus which realizes downsizing and a lower cost.

Embodiment 2

Description will now be made of another embodiment of the image forming apparatus according to the present invention. The image forming apparatus according to the present embodiment is the same as Embodiment 1 in basic construction and operation, and differs in recycled toner recycling control from Embodiment 1. Accordingly, elements identical with or corresponding to those of the image forming apparatus according to Embodiment in construction and function are given the same reference characters and need not be described in detail.

In Embodiment 1, the mixing ratio of the recycled toners and black fresh toner in the toners supplied to the black developing device 12Bk is determined from the ratio of the pure Bk toner in the recycled toners by the use of the data shown in the graph of FIG. 2. As described above, by this method, the recycled toners can be recycled sufficiently efficiently in practical use to thereby prevent the fluctuation of the color taste of a formed image.

In the present embodiment, the fact that Y, M and C toners, when mixed together, become the black color is utilized to further improve the recycling efficiency of the recycled toners.

Here, in the image forming apparatus according to the present embodiment, as in Embodiment 1, if 80 wt % or more of the toners supplied to the black developing device 12Bk is the pure Bk toner, the color taste of the black image is not spoiled whatever color may be the remaining 20 wt %. Accordingly, if the ratio of the pure Bk toner in the recycled toners is 80 wt % or greater, the color taste of the black image is not spoiled even if the toners to be supplied to the black developing device 12Bk are supplied as recycled toners 100 wt % C fresh toner 0 wt %. The image forming apparatus according to the present embodiment is such that Y, M and C toners when mixed together in the same amounts, become a black toner. Accordingly, as a predetermined amount part of each toner ratio in a combination of toners of other colors which can be regarded as the Bk toner, the same amount part of the Y, M and C toner ratios in the recycled toners can be calculated by being added to the Bk toner ratio in the recycled toners. Accordingly, if the total Bk toner in which the pure Bk toner in the supplemental toner and a quasi Bk toner which corresponds to the same amount of Y, M and C toners are added together is 80 wt % or more, the color taste of the black image is not spoiled whatever color may be the remaining 20 wt %. That is, if the relation between the recycled toner ratio [wt %] in the supplemental toner and the total Bk toner ratio [wt %] in the recycled toners is controlled so as to become such as shown in the graph of FIG. 2, the color taste of the black image is not spoiled.

That is, even if for example, the Bk toner is absent in the recycled toners, if the ratios of Y, M and C toners in the recycled toners are the same, the color taste of the black image is not spoiled even if the toners to be supplied to the black developing device 12Bk are supplied as recycled toners 100 wt % (fresh toner 0 wt %).

Accordingly, in the image forming apparatus according to the present embodiment, if 80 wt % or more of the toners supplied into the black developing device 12Bk is a quasi Bk toner (=pure Bk toner+the same amount parts of Y, M and C toners), the color taste of the black image is not spoiled whatever color may be the remaining 20 wt %.

(Recycled Toner Recycling Control)

In the present embodiment, the ratio of each color toner in the recycled toners collected in the toner storage container 50, as in Embodiment 1, is calculated by detecting the ratios of images of the respective colors (in the present embodiment, four colors Y, M, C and Bk) from each color density data of the image data effecting image formation.

The details of a recycled toner recycling control method in the present embodiment will be shown below. The recycled toner recycling method according to the present invention is achieved by following any one or a combination of items (1) to (5) below. Preferably the best result is obtained by following all of the items.

(1) Initial Setting

Initial setting sets the mixing ratio of the recycled toners and fresh toner in the toners supplied to the black developing device 12Bk to recycled toners 100% (fresh toner 0%). For the deficiency in the case of the recycled toners alone, the fresh toner is supplied.

(2) Ratio of Each Color Toner in the Recycled Toners

From each color image ratio of the image data, the ratios of the Y, M, C and Bk color toners in the recycled toners collected in the toner storage container 50 are detected in the same manner as in Embodiment 1.

(3) Total Bk Toner Ratio in the Recycled Toners

From the ratios of Y, M, C and Bk color toners detected in accordance with the item (2) above, the total Bk toner ratio in the recycled toners is calculated by the following calculation expression 4:

(detected Bk toner ratio×0.8)+(the same amount portions of detected Y, M and C toner ratios)=total Bk toner ratio (expression 4)

Here, the ratio of the Bk toner in the recycled toners detected in accordance with the item (2) above includes the recycled toner with plural colors mixed together therein supplied to the black developing device 12Bk. Accordingly, from the data shown in the graph of FIG. 4 adopted in the present embodiment, maximum 20 wt % of the toners in the black developing device 12Bk is toners of other colors (than Bk) excluding the same amount part of Y, M and C color toners regarded as the Bk toner. That is, at least 80 wt % of the toner ratio detected in accordance with the item (2) above is a quasi Bk toner including the same amount part of Y, M and C color toners regarded as the Bk toner.

Accordingly, the ratio of the Bk toner detected in accordance with the item (2) above is multiplied by 0.8 to thereby calculate the ratio of the quasi Bk toner in the recycled toners. Further, the ratio of the same amount part of the ratios of Y, M and C color toners detected in accordance with the item (2) above can be regarded as the Bk toner and therefore, is added to the quasi Bk toner, and with the total value thereof as the total Bk toner ratio, the ratio of the recycled toners in the supplemental toner is determined from the graph of FIG. 4. Thereby, the recycled toners can be recycled more efficiently.

Figure 4:
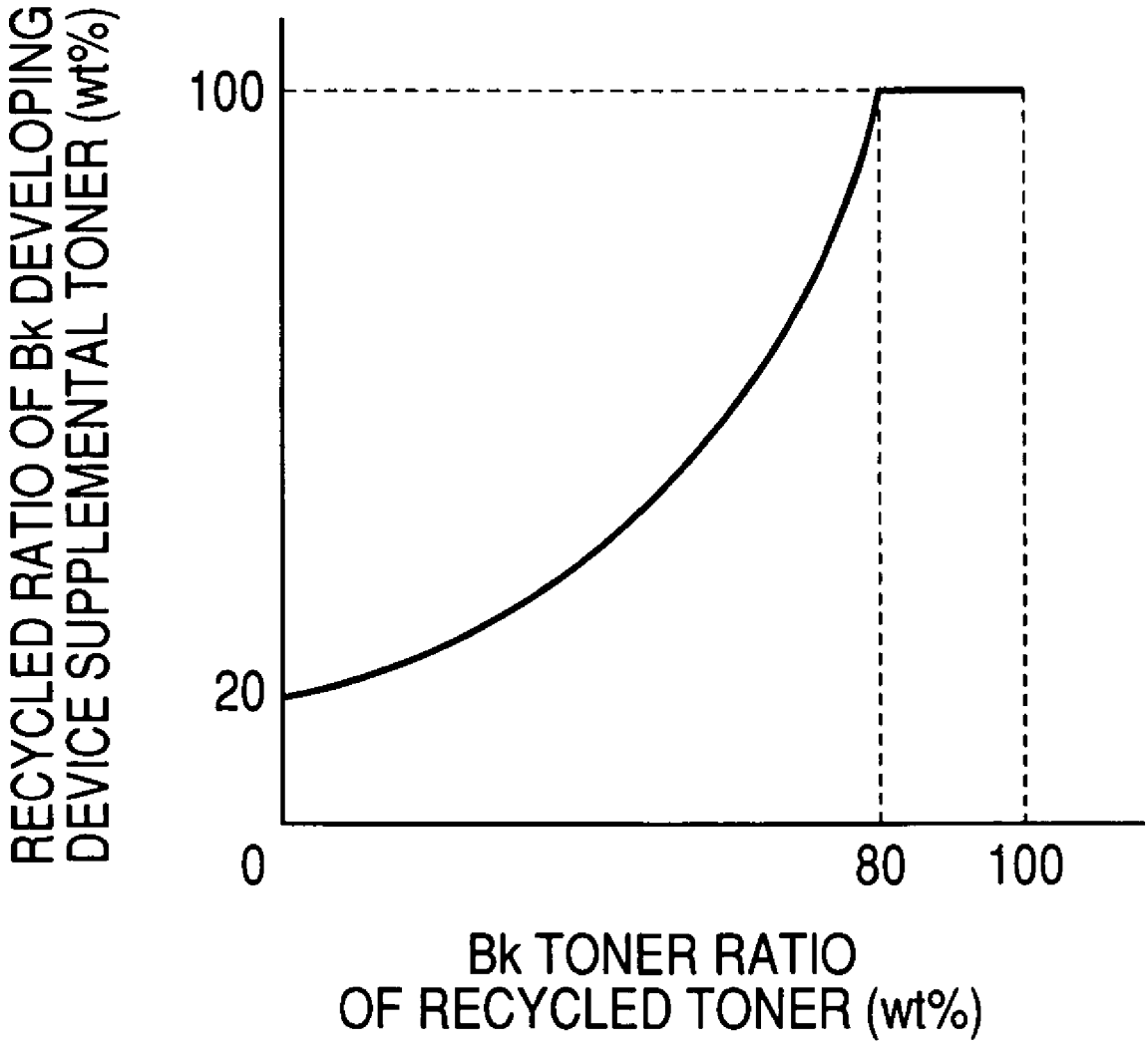
FIG. 4 is a graph showing an example of the calculation of the mixing ratio of the recycled toner and the black toner in the supplemental toner supplied to the black developing device.

(4) Mixing Ratio of the Recycled Toners and Fresh Toner in the Supplemental Toner In conformity with the total Bk toner ratio in the recycled toners calculated in accordance with the item (3) above, the ratio of the recycled toners in the supplemental toner supplied to the black developing device 12Bk is determined from the data shown in the graph of FIG. 4. It is to be understood that the remainder of the supplemental toner is a fresh toner.

That is, the mixing ratio of the recycled toners and fresh toner in the supplemental toner is calculated by the following calculation expressions 5 and 6:

Ratio [wt %] of the recycled toners in the supplemental toner=20 [wt %]/(100 [wt %]−total *Bk* toner ratio [wt %] (however, the minimum is 0 [wt %].) (expression 6)

(Toner Supply to the Black Developing Device)

When the same amount of toner as the toner consumed by the black developing device 12Bk is to be supplied, the fresh toner carrying machine 18Bk and the recycled toner carrying machine 51 are operated at the mixing ratio of the recycled toners and fresh toner determined in accordance with the item (4) above to thereby supply the toner to the black developing device 12Bk. The specific operation of supplying the recycled toners and fresh toner in the supplemental toner by the recycled toner carrying machine 51 and the fresh toner carrying machine 18Bk is similar to that in Embodiment 1.

(Control Mode)

The control mode of the recycled toner recycling control in the present embodiment is generally similar to that in Embodiment 1. In the present embodiment, particularly, as information conforming to the detected ratio of each color toner in the recycled toners, the total Bk toner ratio in the recycled toners temporarily stored in the toner storage container 50 is integrated in the memory 112. The CPU 111 as mixing ratio determining means uses this total Bk toner ratio integrated in the memory 112 for the determination of the mixing ratio of the recycled toners and fresh toner when supplied from the toner storage container 50 to the black developing device 12Bk.

Figure 10:
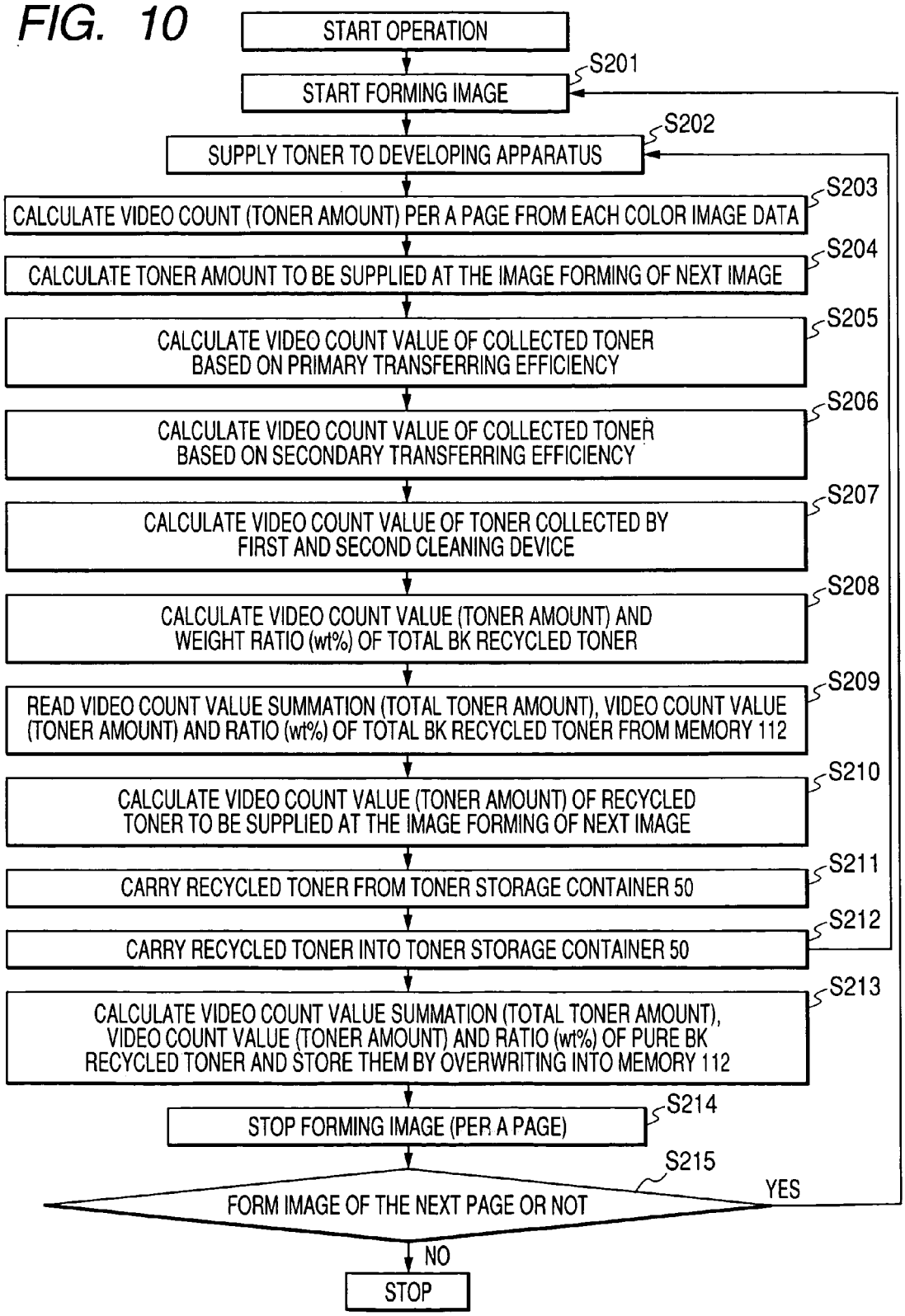
FIG. 10 is a flow chart showing the operation of Embodiment 2 of the present invention.

Here, the total Bk toner ratio is integrated in the memory 112 in the following manner. The ratios of the recycled toners carried out of the toner storage container 50 by the recycled toner carrying machine 51 and the total Bk toner in the recycled toners newly carried into the toner storage container 50 are roughly integrated to thereby always renew the total Bk toner ratio in the recycled toners in the toner storage container 50. More specifically, this will be described below in detail with reference to the flow chart of FIG. 10.

Description will first be made in detail of a method of calculating the total Bk toner in the recycled toners newly carried from the collected toner carrying machines 42 and 43 into the toner storage container 50.

An image is color-resolved into respective toner colors (four colors in the present embodiment), and from an image signal for forming images of the respective toner colors, the numerical value of the density data (absence of toner=0, 50% halftone=128, solid image=256, linear shape) divided into 256 for each pixel (each dot) of the image is integrated per sheet (per page) to thereby calculate the video count values BY, BM, BC and BBk per sheet of each toner color, and the video count sum total value BA per sheet=BY+BM+BC+BBk (S203).

Accordingly, the video count values of the toners used for development on the photosensitive drums 11Y, 11M, 11C and 11Bk by the developing devices 12Y, 12M, 12C and 12Bk in one-sheet image forming operation are BY, BM, BC and BBk.

At this time, by the graph shown in FIG. 8, from toner amounts [g] corresponding to the above-mentioned video count values BY, BM, BC and BBk per sheet, the video count values of the respective colors can be added up to thereby calculate the same toner supply amount [g] for each toner color as the toner consumption amount [g] for each toner color per sheet.

Next, of the toners used for development on the photosensitive drums 11Y, 11M, 11C and 11Bk, the video count values T1BY, T1BM, T1BC and T1Bk of the primary-untransferred toners sent to the photosensitive drum cleaning devices 14Y, 14M, 14C and 14Bk are calculated on the basis of the primary transfer efficiency=90% as described above, as follows (S205):

Primary-untransferred *Y* toner $T1BY=BY\times0.1$

Primary-untransferred *M* toner $T1BM=BM\times0.1$

Primary-untransferred *C* toner $T1BC=BC\times0.1$

Primary-untransferred *Bk* toner $T1BBk=BBk\times0.1$

Also, of the toners primary-transferred onto the intermediate transfer belt 19, the video count values T2BY, T2BM, T2BC and T2BBk of the secondary-untransferred toners sent to the intermediate transfer member cleaning device 30 are calculated on the basis of the secondary transfer efficiency=85% as described above, as follows:

Secondary-untransferred *Y* toner $T2BY[g]=(BY\times0.9)\times0.15$

Secondary-untransferred *M* toner $T2BM[g]=(BM\times0.9)\times0.15$

Secondary-untransferred *C* toner $T2BC[g]=(BC\times0.9)\times0.15$

Secondary-untransferred *Bk* toner $T2BBk[g]=(BBk\times0.9)\times0.15$

The video count values KBY, KBM, KBC and KBBk of the recycled toners carried into the toner storage container 50 in one image forming operation are calculated as follows (S207):

Carried-in *Y* toner $KBY=T1BY+T2BY$

Carried-in $M$ toner $KBM=T1BM+T2BM$

Carried-in $C$ toner $KBC=T1BC+T2BC$

Carried-in $Bk$ toner $KBBk=T1BBk+T2BBk$

Here, in the carried-in toners, the same amount parts of Y, M and C color toners can be regarded as the Bk toner and therefore, the minimum value MinKBYMC part of the video count values of the carried-in toners KBY, KBM and KBC is regarded as the Bk toner. Consequently, the video count value of the same amount parts of Y, M and C color toners in the recycled toners which are regarded as the Bk toner is calculated by 3×MinKBYMC.

The video count sum total value BIN of the recycled toners carried into the toner storage container 50 in one image forming operation is calculated by the carried-in toner sum total value BIN=KBY+KBM+KBC+KBBk.

Also, the video count value KSBBk of the carried-in quasi Bk toner in the recycled toners carried into the toner storage container 50 in one image forming operation is found as follows. That is, maximum 20% of the toners in the black developing device 12Bk is the toner of other color (than Bk) excluding the same amount parts of Y, M and C color toners regarded as the Bk toner and therefore, is calculated by the quasi $Bk$ toner $KSBBk$ in the carried-in $Bk$ toner$=KBBK\times 0.8$, and the video count value KTBBk of the carried-in total Bk toner is calculated by the carried-in total $Bk$ toner $KTBBk=KSBBk+(3\times \mathrm{Min}KBYMC)$ (S208)

Consequently, the carried-in total Bk toner ratio [wt %] in the recycled toners carried into the toner storage container 50 in one (one-page) image forming operation is calculated by the carried-in total $Bk$ toner ratio [wt %]$=(KTBBk/BIN)\times 100$ (S208).

(Here, in a case where the toner storage container 50 is not disposed, but the recycled toners are directly carried to the black developing device 12Bk, and are mixed with the fresh toner for recycling, the mixing ratio of the fresh toner and the recycled toners is determined by FIG. 4 by the use of the aforementioned carried-in total Bk toner ratio [wt %].

Description will now be made in detail of a method of calculating the recycled toners carried out of the toner storage container 50 by the recycled toner carrying machine 51 during the image forming operation for the next page.

In the image forming operation for the preceding page, the toner amount [g] calculated from the above-mentioned video count value BBk per sheet by FIG. 8 is the toner amount [g] consumed by the black developing device 12Bk. The same amount as this toner amount [g] is supplied as the supplemental toner (the recycled toners+the fresh toner) during the image forming operation for the next page.

The total Bk toner ratio (n−1)TBk [wt %] in the recycled toners in the toner storage container 50, the video count value (n−1)TBBk of the total Bk toner, and the video count sum total value (n−1)RBA of the recycled toners in the toner storage container 50 before the recycled toners produced in the image forming operation for the preceding page are carried into the toner storage container 50 are read from the memory 112 (S209).

The video count value (toner amount) of the recycled toners to be mixed with the fresh toner and be supplied to the developing device 12Bk at the image forming of the next page is calculated from the total Bk toner ratio (wt %) of the recycled toners in the toner storage container 50 (S210).

From the graph of FIG. 4, the recycled toner ratio (n−1)R [wt %] in the supplemental toner to be supplied during the image forming operation for the next page is calculated by the recycled toner ratio $(n-1)R$ [wt %] in the supplemental toner=20 [wt %]/100 [wt %]$-(n-1)TBk$ [wt %]×100 (however, the upper limit is 100 wt %).

Accordingly, the video count value BOUT of the carried-out recycled toners is calculated by $BOUT=BBk\times(n-1)R/100$ (S210).

Also, the video count value FBBk of the fresh toner in the supplemental toner is calculated by FBBk=BBk−BOUT.

Here, the recycled toner amount [g] and fresh toner amount [g] in the supplemental toner are found by a toner amount [g] corresponding to the video count values BOUT and FBBk, from the graph of FIG. 8.

Further, description will hereinafter be made in detail of a method of calculating the total Bk toner ratio (n)TBk [wt %] after during the image forming operation for the next page, a recycled toner amount corresponding to the video count value BOUT has been carried out of the toner storage container 50 by the recycled toner carrying machine 51 (S211, S202), whereafter the carried-in toner sum total value BIN for the preceding page has been carried from the collected toner carrying machines 42 and 43 into the toner storage container 50 (S212).

The total Bk toner ratio (n)TBk [wt %] in the recycled toners in the toner storage container 50, the video count value (n)TBBk of the total Bk toner, and the video count sum total value (n)RBA of the recycled toners in the toner storage container 50 after the recycled toners corresponding to BOUT have been carried out an the recycled toners corresponding to BIN have been carried in are calculated as follows. First, the video count sum total value (n) RBA of the recycled toners in the toner storage container 50 is calculated by the recycled toner sum total value $(n)$ $RBA=(n-1)RBA-BOUT+BIN$.

Then, the video count value (n) TBBk of the total Bk toner is calculated by the $Bk$ toner $(n)$ $TBBk=(((n-1)RBA-BOUT)\times(n-1)TBk[\text{wt }\%]/100)+KTBBk$.

Accordingly, the total Bk toner ratio (n) TBk [wt %] of the recycled toners in the toner storage container 50 is calculated by total $Bk$ toner ratio $(n)$ $TBk[\text{wt }\%]=TBBk/(n)RBA\times 100$.

Then, the total Bk toner ratio (n) TBk [wt %] in the recycled toners in the toner storage container 50, the video count value (n) TBBk of the total Bk toner and the video count sum total value (n) RBA of the recycled toners in the toner storage container 50 are renewed and stored in the memory 112.

This total Bk toner ratio (n) TBk [wt %] of the recycled toners in the toner storage container 50 is further used for the calculation of the recycled toner ratio in the supplemental toner when the same amount of supplemental toner as the Bk toner consumed by the image forming operation for the next page is supplied to the black developing device 12Bk during the image formation of the second next page.

The calculations as described above are repeated for each sheet (each page) (S214, S215, S201), to thereby always renew the total Bk toner ratio in the recycled toners in the toner storage container 50.

Also, in the present construction, if the conveying routes of the recycled toner carrying machine 51 and the collected toner carrying machines 41 (41Y, 41M, 41C, 41Bk), 42 and 43 are shortened as much as the construction of the image forming apparatus allows, the error from the result of the calculation of the total Bk toner ratio in the recycled toners in the toner storage container 50 can be made small, and this is more preferable.

In the present embodiment, there is adopted the control of calculating the total Bk toner ratio in the recycled toners in the toner storage container 50 on the basis of the video count value to thereby calculate the mixing ratio of the recycled toners and fresh toner in the supplemental toner. However, this is not restrictive, but the toner amount [g] to the video count value can be calculated from the relation of FIG. 8 between the video count value and the toner amount [g] and therefore, there may be adopted the control of calculating the aforementioned total Bk toner ratio on the basis of the toner amount [g].

Also, in the present embodiment, there is adopted a construction in which the recycled toner to be used as the supplemental toner is carried out of the toner storage container 50, whereafter the collected toners are carried into the toner storage container 50. However, this is not restrictive, but depending on the image forming apparatus, there may be adopted a construction in which after the collected toners have been carried into the toner storage container 50, the recycled toners to be used as the supplemental toner are carried out of the toner storage container 50.

EXAMPLES OF EXPERIMENT

In fact, the formation of various images such as documents (black-and-white images) and photographs (full-color images) was effected and a test was carried out. The same conventional image forming apparatus as that used as a comparison in Embodiment 1 was used as a comparison and the same test was carried out.

As a result, in the conventional image forming apparatus, the toner disposal container 40 became full of the toners for 20,000 sheets (A4 size) and the disposal thereof was necessary.

On the other hand, in the image forming apparatus of FIG. 1 adopting the recycled toner recycling control according to the present embodiment, there was no recycled toner in the toner disposal container 40 even for 20,000 sheets (A4 size). Thereby, it has been found that in practical use, it is not necessary to interchange the toner disposal container 40, and a countermeasure for environment which does not produce waste can be realized.

Also, as compared with the conventional image forming apparatus, in the image forming apparatus adopting the recycled toner recycling control according to the present embodiment, the consumed amount of the black fresh toner decreased to about 40%. Also, as regards the black image and the color images, clear-cut images could be outputted as both with an equal color taste, and it has been found that a low running cost and the stability of the color taste of image can be realized.

In the present embodiment, as compared with Embodiment 1, the same amount parts of Y, M and C toners can also be regarded as the quasi Bk toner, and this leads to the advantage that particularly during color image formation, the recycling rate of the recycled toners is improved and the effect of reducing the consumed amount of the fresh toner becomes great.

In the present embodiment, there is adopted a toner which becomes black when the same amounts of Y, M and C color toners are mixed therewith. However, this is not restrictive, but depending on the composition of the pigment or the like of toner, there is a toner which becomes black when Y, M and C toners are mixed therewith not in the same amount but at a predetermined ratio. When such a toner is adopted, it is good to effect correction in conformity with the aforementioned predetermined ratio in the calculation expression of the total Bk toner ratio. More specifically, in a case where there is adopted, for example, a toner which becomes black when as a predetermined amount part of toners of other colors which can be regarded as the Bk toner, Y, M and C toners are mixed together at a ratio of "Y:M:C=1:1.05:1.1", the part which is the above-mentioned ratio is regarded as the Bk toner and the total Bk toner ratio is calculated.

Consequently, in the calculation of the aforedescribed same amount parts of Y, M and C color toners, y, M and C toners are changes so as to be mixed together at the ratio of "Y:M:C=1:1.05:1.1".

Specifically, in the case of the above-mentioned ratio, the video count values of Y, M and C toners regarded as the Bk toner are defined as quasi black Y toner part MBY=(1/1.1)×MinKBYMC, quasi black M toner part MBM=(1.05/1.1)×MinKBYMC, and quasi black C toner part MBC=MinKBYMC, respectively, and the video count value KTBBk of the carried-in total Bk toner is calculated by $$\text{carried-in total } Bk \text{ toner } KTBBk=RSBBk+(MBY+MBM+MBC).$$

Consequently, the carried-in total Bk toner ratio [wt %] in the recycled toners carried into the toner storage container 50 in one (one-page) image forming operation is calculated by $$\text{carried-in total } Bk \text{ toner ratio [wt \%]}=(KTBBk/BIN)\times 100.$$

As described above, according to the recycled toner recycling control in the present embodiment, an operational effect similar to that of Embodiment 1 can be achieved and also, the recycling efficiency of the recycled toners can be further improved.

Embodiment 3

Description will now be made of another embodiment of the image forming apparatus according to the present invention.

Figure 5:
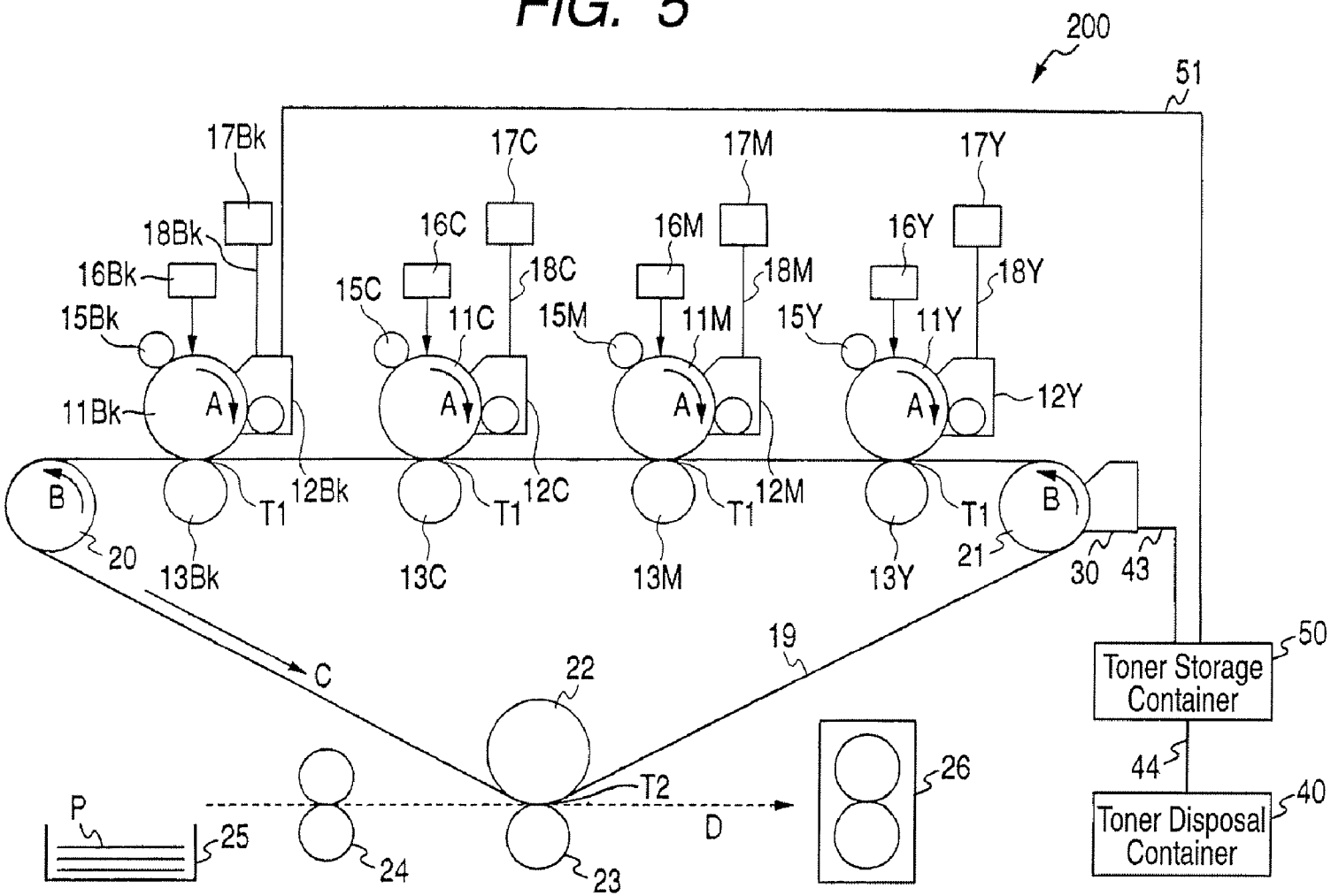
FIG. 5 is a typical cross-sectional view of another embodiment of the image forming apparatus according to the present invention.

FIG. 5 schematically shows the construction of an image forming apparatus 200 according to the present embodiment. In the present embodiment, the image forming apparatus 200 is of a tandem type intermediate transfer type and adopts a photosensitive drum cleanerless process. In the image forming apparatus 200 shown in FIG. 5, elements identical with or corresponding to those in the image forming apparatus 100 according to Embodiment 1 shown in FIG. 1 in construction and function are given the same reference characters and need not be described in detail.

The image forming apparatus 200 according to the present embodiment a photosensitive drum cleanerless system of a cleaning simultaneous with developing type which collects any primary-untransferred toners on photosensitive drums into developing devices 12Y, 12M, 12C and 12Bk during the next developing operation and recycles them.

This cleanerless system acts particularly well by using spherical polymerized toners produced by a polymerizing method. The polymerized toners, as compared with conventional crushed toners, are small in the mirroring power and van der Wals force, i.e. adhering force of toner to the photosensitive drum.

Accordingly, the primary-untransferred toners during transfer are small in amount and become great in the toners collecting effect from the photosensitive drum during development, and cleaning simultaneous with developing becomes possible and thus, the photosensitive drum cleanerless system can be realized.

That is, the image forming apparatus 200 according to the present embodiment adopts the photosensitive drum cleanerless system and therefore, eliminates the photosensitive drum cleaning devices (first cleaning devices) 14Y, 14M, 14C, 14Bk of the image forming apparatus 100 (FIG. 1) according to Embodiment 1.

On the other hand, the toners collected by the intermediate transfer cleaning device 30, as in the image forming apparatus 100 (FIG. 1) according to Embodiment 1, are collected as recycled toners into the toner storage container 50 by the toner carrying machine 43 as toner carrying means.

The recycled toners with plural colors mixed together therein collected into the toner storage container 50 are carried to the black developing device 12Bk by the recycled toner carrying machine 51 as toner carrying means, and are mixed with a black fresh toner supplied from the toner supplying container 17Bk and are recycled.

Again in the present embodiment, the photosensitive drum cleaning devices are only eliminated and recycled toner recycling control similar to that in Embodiment 1 or Embodiment 2 is applied, whereby an operational effect similar to that of Embodiments 1 and 2 can be achieved.

Also, in the present embodiment, particularly the recycled toners by the primary-untransferred toners from the photosensitive drums 11Y, 11M, 11C and 11Bk are absent, and the recycled toners are only the secondary-untransferred toners collected by the intermediate transfer member cleaning device 30. Thus, the probability with which the toner storage container 50 becomes full of the recycled toners decreases, and in practical use, the probability with which the toner disposal container 40 is interchanged is very small, and this leads to the advantage that waste is hardly produced.

Further, the present embodiment not only decreases the fresh toner consumption amount, but also as compared with the image forming apparatus according to Embodiment 1 shown in FIG. 1, it collects and recycles the primary-untransferred toners by the respective developing devices and can therefore decrease the consumed amounts of Y, M and C toners, and can provide an image forming apparatus of a low running cost.

Here, the invention of Japanese Patent Application Laid-open No. 2001-337503 has a construction in which when a toner of other color gets mixed in a developing device by a reversely transferred toner, the toner is consumed (discharged) and is absorbed into a downstream developing device. If the present embodiment is applied to such a construction, any change in the color taste by the reversely transferred toner in each developing device can be efficiently prevented. For example, the present embodiment is applied so that the toner discharged by each developing device may not absorbed by a downstream developing device, but the video count value of the toner discharged by each developing device may be detected, and the toners may be collectively absorbed by the intermediate transfer member cleaning device, and may be recycled as recycled toners by the black developing device 12Bk. Thereby, as compared with a construction in the invention of Japanese Patent Application Laid-open No. 2001-337503 wherein each time the color mixing rate of the downstream developing device exceeds its limit, the downstream developing device is caused to further discharge and absorb the toner, the discharge amount can be set to an amount greater than the limit of the absorbed amount by the downstream developing device. As a result, the change in the color taste by the reversely transferred toner in each developing device can be efficiently prevented and at the same time, there is the advantage that the secondary-untransferred toners on the intermediate transfer member can also be recycled.

Embodiment 4

Description will now be made of another embodiment of the image forming apparatus according to the present invention.

Figure 6:
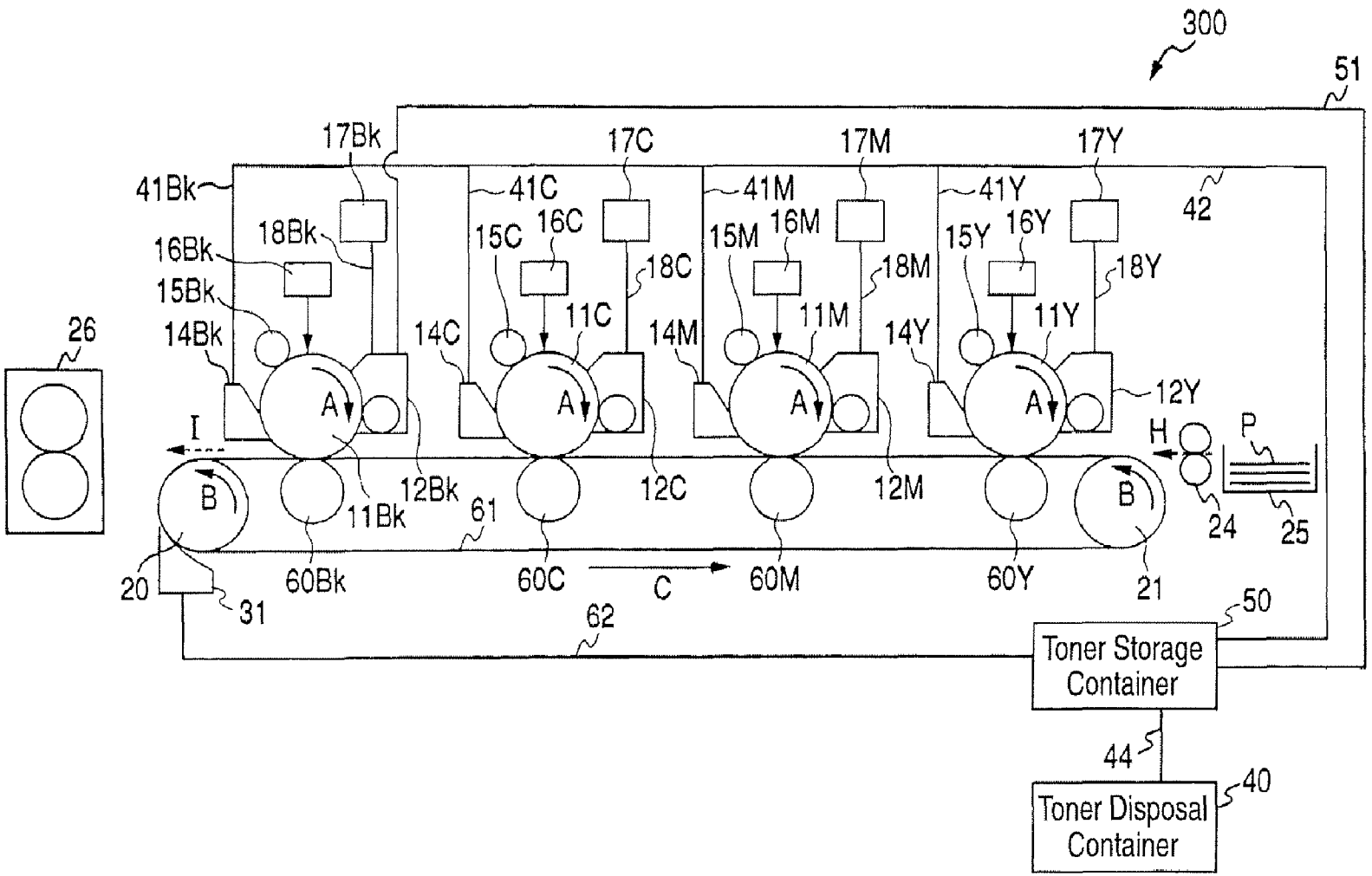
FIG. 6 is a typical cross-sectional view of still another embodiment of the image forming apparatus according to the present invention.

FIG. 6 schematically shows the construction of an image forming apparatus 300 according to the present embodiment. In the present embodiment, the image forming apparatus 300 adopts a tandem type direct transfer system. In the image forming apparatus 300 shown in FIG. 6, elements identical with or corresponding to those in the image forming apparatus 100 according to Embodiment 1 shown in FIG. 1 in construction and function are given the same reference characters and need not be described in detail.

In the image forming apparatus according to the present embodiment, a recording material P is conveyed along a route indicated by broken line H at predetermined timing by registration rollers 24, and is electrostatically attracted to a recording material conveying belt 61 as a recording material conveying member. The recording material P attracted to the recording material conveying belt 61 is conveyed to the transfer nip parts between photosensitive drums 11Y, 11M, 11C, 11Bk and transfer rollers 60Y, 60M, 60C, 60Bk. Thereby, toner images on the photosensitive drums 11Y, 11M, 11C and 11Bk are directly and multiplexly transferred onto the recording material P by the transfer rollers 60Y, 60M, 60C and 60Bk to which a predetermined bias has been applied. The recording material conveying belt 61 is passed over a drive roller 20 and a supporting roller 21, and the drive roller 20 is rotated in the direction of arrow B, whereby the recording material conveying belt 61 is moved round in the direction of arrow C. The recording material conveying belt 61 constitutes an image conveying member for conveying the toner images received from image forming means provided with the photosensitive drums, charging rollers, exposing devices, developing devices, primary transfer rollers, etc. and forming on the photosensitive drums the toner images to be transferred to a transfer member, i.e., transferred onto the recording material P borne thereon.

Then, the recording material P bearing the toner images thereon is separated from the recording material conveying belt 61, is conveyed along a route indicated by broken line I and is conveyed to a fixing device 26. The toner images on the recording material P are pressurized and heated by the fixing device 26, and the toner images are fixed on the recording material P.

In the present embodiment, the toners collected by photosensitive drum cleaning devices (first cleaning devices) 14Y, 14M, 14C and 14Bk are carried by first collected toner carrying machines 41Y, 41M, 41C and 41Bk as toner carrying means, and are further collected as recycled toners into a toner storage container 50 by a second collected toner carrying machine 42.

Also, the toners collected by a recording material conveying member cleaning device (second cleaning device) 31 are collected as recycled toners into the toner storage container 50 by a third collected toner carrying machine 62 as toner carrying means.

The recycled toners with plural colors mixed together therein collected in the toner storage container 50 are carried to a black developing device 12Bk by a recycled toner carrying machine 51, and are mixed with a black fresh toner supplied from a toner supplying container 17Bk and are recycled. Again in the present embodiment, recycled toner recycling control can achieve an operational effect similar to that of Embodiment 1 or 2 by applying thereto control similar to that in Embodiment 1 or Embodiment 2.

Also, in the present embodiment, particularly the recycled toners collected by the second cleaning device 31 are only fogged toners (slight amounts of toners adhering to the other portions than the image portions of the photosensitive drums) transferred from the photosensitive drums 11Y, 11M, 11C and 11Bk onto the other portion of the recording material conveying belt 61 than the recording material P attracted to the recording material conveying belt 61 and therefore, are very small in amount. Accordingly, the probability with which the toner storage container 50 becomes full of the recycled toners decreases, and in practical use, the probability with which the toner disposal container 40 is interchanged is very small, and this leads to the advantage that waste is hardly produced.

Embodiment 5

Description will now be made of still another embodiment of the image forming apparatus according to the present invention.

Figure 7:
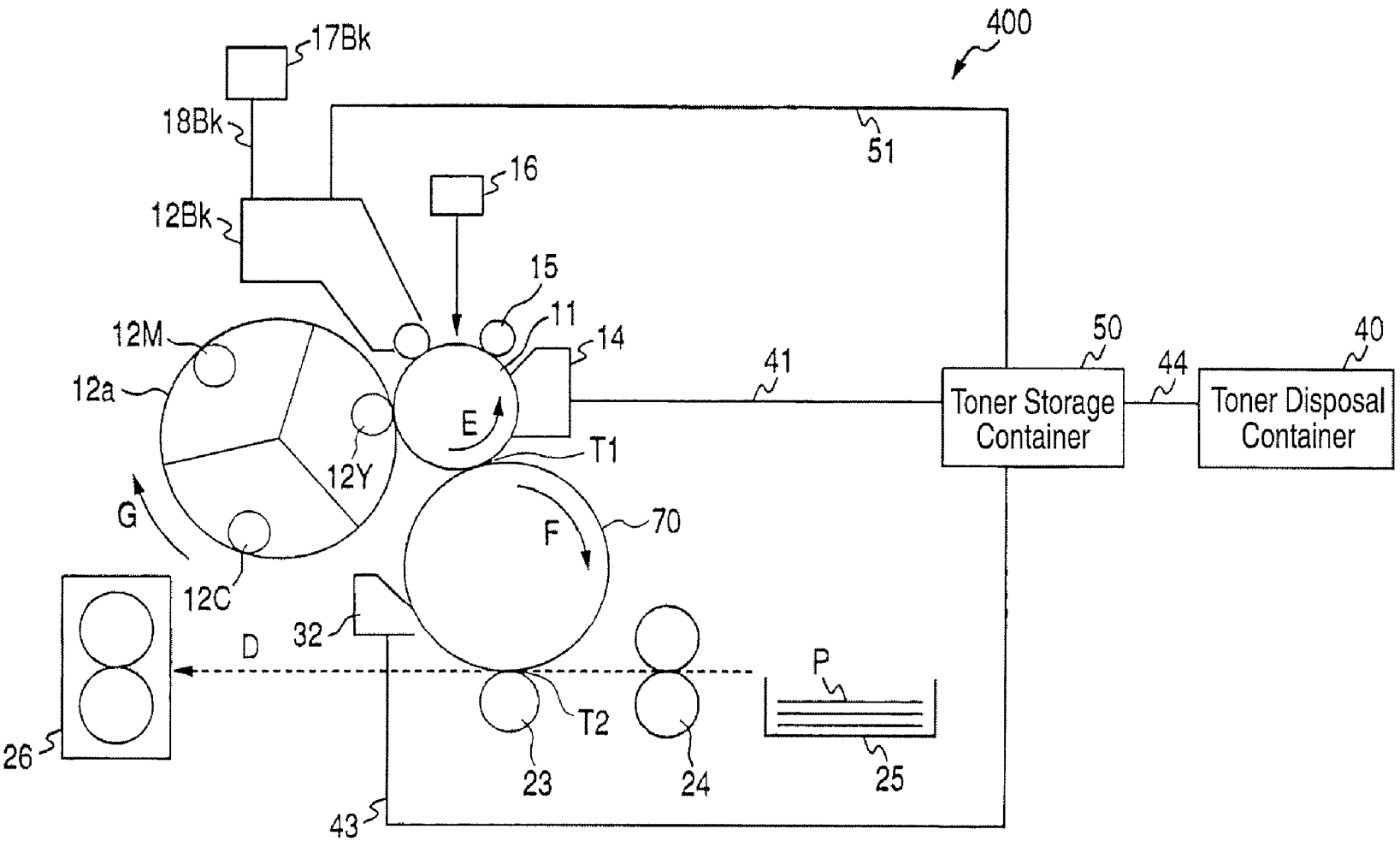
FIG. 7 is a typical cross-sectional view of yet still another embodiment of the image forming apparatus according to the present invention.

FIG. 7 shows an example of a color image forming apparatus of a drum type intermediate transfer type illustrating Embodiment 5 of the present invention. In the image forming apparatus 400 shown in FIG. 7, elements identical with or corresponding to those in the image forming apparatus 100 according to Embodiment 1 shown in FIG. 1 in construction and function are given the same reference characters and need not be described in detail.

The image forming apparatus according to the present embodiment is such that toner images of Y, M, C and Bk colors formed on a photosensitive drum 11 are successively primary-transferred onto an intermediate transfer drum 70 as an intermediate transfer member and are superposed one upon another, and multiple transferred toner images of four colors on the intermediate transfer drum 70 are collectively secondary-transferred onto a recording material P.

The photosensitive drum 11 is rotatively driven in the direction of arrow E. A charging roller 15 uniformly charges the surface of the photosensitive drum 11. That is, the charging roller 15 has a predetermined bias applied thereto, and is driven to rotate by the photosensitive drum 11 and charges the surface of the photosensitive drum 11 to predetermined potential. The charged photosensitive drum 11 is subjected to exposure by exposure light (such as a laser beam) from an exposing device 16, whereby an electrostatic latent image corresponding to the color-resolved image of an input original is formed thereon.

The electrostatic latent image formed on the photosensitive drum 11 is developed into desired colors by developing devices 12Y, 12M and 12C for yellow (Y), magenta (M) and cyan (C) mounted on a rotary member 12*a* rotatable about a predetermined rotary shaft, and a black developing device 12Bk disposed in an image forming apparatus main body discretely from the rotary member 12*a*. The rotary member 12*a* is adapted to be rotated at predetermined timing to thereby dispose the developing devices 12Y, 12M and 12C for yellow (Y), magenta (M) and cyan (C) at a position opposed to the photosensitive drum 11 so as to be used for the developing step.

For example, during the formation of a four-color full-color image, the yellow developing device 12Y first effects reversal development by the use of a charged toner to thereby form a toner image corresponding to the electrostatic latent image on the surface of the photosensitive drum 11. The toner image on the photosensitive drum 11 is rotated in the direction of arrow F at substantially the same speed as the photosensitive drum 11, and the Y toner image is primary-transferred onto the intermediate transfer drum 70 as an intermediate transfer member to which a predetermined bias has been applied.

Any primary-untransferred toner on the photosensitive drum 11 after the primary transfer is collected by a photosensitive drum cleaning device (first cleaning device) 14 having a blade, a brush or the like disposed thereon, and the photosensitive drum 11 from which the primary-transferred toner has been thus removed is again uniformly charged by the charging roller 15 and becomes ready for the next image forming.

Next, the developing devices 12Y, 12M and 12C are rotated in the direction of arrow G, and in the same manner as previously described, a toner image is formed on the surface of the photosensitive drum by the magenta developing device 12M, and the M toner image is primary-transferred onto the intermediate transfer drum 70. Further, the developing devices are rotated in the direction of arrow G, and in the same manner as previously described, a toner image is formed on the surface of the photosensitive drum 11 by the cyan developing device 12C, and the C toner image is primary-transferred onto the intermediate transfer drum 70. Then, in the same manner as previously described, a toner image is formed on the surface of the photosensitive drum 11 by the black developing device 12Bk, and the Bk toner image is primary-transferred onto the intermediate transfer drum 70.

In the present embodiment, black images such as documents are more often formed and therefore, in order to make a larger capacity possible, the black developing device 12Bk is disposed discretely from the construction the developing devices 12Y, 12M and 12C are mounted on the rotary member 12*a* and are rotated so that their developing regions may be opposed to the photosensitive drum 11 to thereby effect development. Depending on the construction of the image forming apparatus, there may be adopted a construction in which the developing devices for all the colors including the black developing device 12Bk are mounted on the rotary member 12*a*, or conversely, if it is possible to make the photosensitive drum 11 large, there may be adopted a construction in which the developing devices 12Y, 12M, 12C and 12Bk for all the colors are disposed around the photosensitive drum 11 discretely from one another.

The above-described operation is performed, whereby the toner images formed on the photosensitive drum 11 are successively multiplexly transferred onto the intermediate transfer drum 70.

In the case of the formation of a four-color full-color image, the intermediate transfer drum 70 makes four full rotations, whereby the toners are primary-transferred onto the intermediate transfer drum 70 in the order of Y, M, C and Bk (the order of colors is arbitrary depending on the image forming apparatus). In the case of a two- to three-color mode, the intermediate transfer drum 70 makes two to three full rotations, and the primary transfer is completed.

On the other hand, the recording material P taken out of a cassette 25 is supplied at predetermined timing by a pair of registration rollers 24, and is conveyed to a primary transferring portion T2. Then, the toner images are secondary-transferred from the intermediate transfer drum 70 onto the recording material P by a secondary transfer roller 23 to which a predetermined bias has been applied. The recording material P onto which the toner images have been secondary-transferred is conveyed along a conveying route indicated by broken line D, and is conveyed to a fixing device 26, whereby the toner images are fixed on the recording material P.

In the case of single-color print (single-color image forming), primary transfer is effected, whereafter a toner image is conveyed on the intermediate transfer drum 70 to the secondary transfer roller 23, and is secondary-transferred onto the recording material P before the intermediate transfer drum 70 makes one full rotation.

Accordingly, as compared with four-color full-color image forming, single-color image forming is about four times as great in productivity.

Any secondary-untransferred toners on the intermediate transfer drum 70 after the secondary transfer of the toner images are collected by an intermediate transfer member cleaning device (second cleaning device) 32 having a blade, a brush or the like disposed thereon, and the intermediate transfer drum 70 from which the secondary-untransferred toners have been removed again becomes ready for the primary transfer of the next image forming.

During color image forming, in order not to disturb the toner images on the intermediate transfer drum 70 being primary-transferred, the blade or the brush of the second cleaning device 32 is made movable, and is adapted to be retracted so as to be in non-contact with the intermediate transfer drum 70 during the primary transfer, and on the other hand, is adapted to contact with the intermediate transfer drum 70 during the secondary-untransferred toner cleaning of the intermediate transfer drum 70.

Also, during color image forming, in order not to disturb the toner images on the intermediate transfer drum 70 being primary-transferred, the secondary transfer roller 23 is made movable, and is adapted to be retracted so as to be in non-contact with the intermediate transfer drum 70 during the primary transfer, and is adapted to contact with the intermediate transfer drum 70 during the secondary transfer.

The toners collected by the first cleaning device 14 are carried by a first collected toner carrying machine 41 as toner carrying means, and are collected as recycled toners into a toner storage container 50.

Also, the toners collected by the second cleaning device 32 are carried by a second collected toner carrying machine 43 as toner carrying means, and are collected as recycled toners into the toner storage container 50.

The recycled toners with plural colors mixed together therein collected in the toner storage container 50 are carried to the black developing device 12Bk by a recycled toner carrying machine 51 as toner carrying means, and are mixed with a black fresh toner supplied from a toner supplying container 17Bk and are recycled.

Again in the present embodiment, the recycled toner recycling control can achieve an operational effect similar to that of Embodiment 1 or 2 by applying control similar to that in Embodiment 1 or Embodiment 2 thereto.

In the present embodiment, particularly the one-drum type color image forming apparatus, as compared with a tandem type color image forming apparatus, has the advantage that the downsizing and lower cost of the image forming apparatus can be realized.

Also, in the present embodiment wherein the present invention is applied to a one-drum type color image forming apparatus, again in a construction wherein toners of plural colors are mixedly present in the photosensitive drum cleaning device 14, the recycling efficiency of the recycled toners is similar to that in Embodiments 1 and 2, and the present invention has the advantage of having the flexibility with which it can be applied to various image forming apparatuses.

While the present invention has been hitherto described with respect to the specific embodiments thereof, it should be understood that the numerical values in the above-described embodiments, unless particularly restrictively described are examples for simplifying the description of the embodiments, and the aforementioned numerical values can be arbitrarily determined in conformity with the construction and setting or the like of the image forming apparatus. Also, it should be understood that the present invention is not restricted to the image forming apparatus described in the foregoing embodiments, but various changes such as arbitrary combinations of the embodiments are possible without departing from the spirit of the present invention.

This application claims priority from Japanese Patent Application No. 2004-196085 filed Jul. 1, 2004, which is hereby incorporated by reference herein.

What is claimed is:

1. An image forming apparatus comprising:

an image bearing member;

a plurality of developing means which develop a yellow toner image with yellow toner, a magenta toner image with magenta toner, a cyan toner image with cyan toner or a black toner image with black toner on said image bearing member, one of said plurality of developing means being black toner developing means for developing a black toner image with black toner;

transfer means for transferring toner images on said image bearing member onto a transferring material;

cleaning means for cleaning residual toners on said image bearing member after said transfer means transfers the toner images;

toner containing portion for collecting yellow toner, magenta toner, cyan toner or black toner cleaned by said cleaning means;

a supply toner containing portion for containing black toner supplied to the black toner developing means;

a first detection means for detecting a ratio of an amount of collected black toner in said toner containing portion to a total amount of toners in said toner containing portion;

a second detection means which selects a least amount among an amount of collected yellow toner in said toner containing portion, an amount of collected magenta toner in said toner containing portion and an amount of collected cyan toner in said toner containing portion, and which detects the sum of the least amount, a first predetermined ratio corresponding to a first amount multiplied by the least amount and a second predetermined ratio corresponding to a second amount multiplied by the least amount to the total amount of toner in said toner containing portion; and changing means for changing a ratio of a supply amount supplied to the black toner developing means from said supply toner containing portion to a supply amount supplied to the black toner developing means from said toner containing portion, based on an output of said first detection means and an output of said second detection means.

2. An image forming apparatus according to claim 1, wherein when a sum of a detection value by said first detection means and a detection value by said second detection means increase, said changing means increases the amount of toner from said toner containing portion.

3. An image forming apparatus according to claim 1, further comprising a first conveyance means for conveying toner from said toner containing portion to the black toner developing means.

4. An image forming apparatus according to claim 3, further comprising a second conveyance means for conveying toner from said supply toner containing portion to the black toner developing means.

5. An image forming apparatus according to claim 1, wherein an amount of one color toner in said toner containing portion is calculated based on an image forming signal of each color.

6. An image forming apparatus according to claim 1, wherein an amount of one color toner in said toner containing portion is calculated based on an amount of the toner supplied to one of developing means for one color among said plurality of developing means.

7. An image forming apparatus comprising:

a plurality of image bearing members;

a plurality of developing means which develop a yellow toner image with yellow toner, a magenta toner image with magenta toner, a cyan toner image with cyan toner or a black toner image with black toner on said image bearing member, each of said plurality of developing means being provided for each one of said plurality of image bearing members, one of said plurality of developing means being black toner developing means for developing a black toner image with black toner;

a plurality of cleaning means, each of which is provided on each of said plurality of image bearing members to clean toner on each of said image bearing member after said transfer means transfers the toner images;

toner containing portion for collecting yellow toner, magenta toner, cyan toner or black toner cleaned by said cleaning means;

a supply toner containing portion for containing black toner supplied to the black toner developing means;

a first detection means for detecting a ratio of an amount of black toner to a total amount of toners in said toner containing portion;

a second detection means which selects a least amount among an amount of collected yellow toner in said toner containing portion, an amount of collected cyan toner in said toner containing portion and an amount of collected magenta toner in said toner containing portion, and which detects the sum of the least amount, a first predetermined ratio corresponding to a first amount multiplied by the least amount and a second predetermined ratio corresponding to a second amount multiplied by the least amount to the total amount of toner in said toner containing portion; and changing means for changing a ratio of a supply amount supplied to the black toner developing means from said supply toner containing portion to a supply amount supplied to the black toner developing means from said toner containing portion, based on an output of said first detection means and an output of said second detection means.

8. An image forming apparatus according to claim 7, wherein when a sum of the detection value by said first detection means and the detection value by said second detection means increase, said changing means increases the amount of toner from said toner containing portion.

9. An image forming apparatus according to claim 7, further comprising a first conveyance means for conveying toner from said toner containing portion to the black toner developing means.

10. An image forming apparatus according to claim 9, further comprising a second conveyance means for conveying toner from said supply toner containing portion to the black toner developing means.

11. An image forming apparatus according to claim 7, wherein an amount of one color toner in said toner containing portion is calculated based on an image forming signal of each color.

12. An image forming apparatus according to claim 7, wherein an amount of one color toner in said toner containing portion is calculated based on an amount of the toner supplied to one of developing means for one color among said plurality of developing means.

* * * * *

UNITED STATES PATENT AND TRADEMARK OFFICE

CERTIFICATE OF CORRECTION

PATENT NO. : 7,366,457 B2
APPLICATION NO. : 11/168355
DATED : April 29, 2008
INVENTOR(S) : Kazuaki Ono It is certified that error appears in the above-identified patent and that said Letters Patent is hereby corrected as shown below:

IN THE TITLE PAGE:

At Item (56), References Cited, FOREIGN PATENT DOCUMENTS, "07191586 A" should read --7-191586 A--.

On page 2, "09096939 A" should read --9-96939 A-- and "2002365873 A" should read --2002-365873 A--.

COLUMN 11:

Line 4, "on" should be deleted.

COLUMN 16:

Line 53, "ration" should read --ratio--.
Line 64, "ration" should read --ratio--.

COLUMN 20:

Lines 28 and 29, "during the image forming operation for the next page," should be deleted.

Line 32, "(S102)," should read --(S102) during the image forming operation for the next page,--.

COLUMN 21:

Line 5, "calculation s" should read --calculations--.
Line 18, "ration" should read --ratio--.
Line 39, "ration" should read --ratio--.
Line 47, "ration" should read --ratio-- and "mans" should read --means--.

COLUMN 29:

Line 16, "dispose" should read --disposes--.
Line 64, "100 wt % C" should read --100 wt % C,--.

UNITED STATES PATENT AND TRADEMARK OFFICE

CERTIFICATE OF CORRECTION

PATENT NO. : 7,366,457 B2
APPLICATION NO. : 11/168355
DATED : April 29, 2008
INVENTOR(S) : Kazuaki Ono It is certified that error appears in the above-identified patent and that said Letters Patent is hereby corrected as shown below:

COLUMN 30:
Line 21, "100 wt %" should read --100 wt %,--.
Line 45, "toners 100%" should read --toners 100%,--.

COLUMN 36:
Line 21, "y," should read --Y,--.
Line 22, "changes" should read --changed--.

COLUMN 37:
Line 55, "other" should read --another--.

COLUMN 40:
Line 45, "construction" should read --construction in which--.

Signed and Sealed this

Twenty-eighth Day of October, 2008

JON W. DUDAS
*Director of the United States Patent and Trademark Office*